US011310575B2

(12) United States Patent
Nam et al.

(10) Patent No.: US 11,310,575 B2
(45) Date of Patent: Apr. 19, 2022

(54) SPEAKER GRILL WITH GRADUATED HOLE SIZING OVER A TRANSITION AREA FOR A MEDIA DEVICE

(71) Applicant: Sonos, Inc., Santa Barbara, CA (US)

(72) Inventors: Youjin Nam, Santa Barbara, CA (US); Nicholas Long, Santa Barbara, CA (US); Tetsuro Oishi, Santa Barbara, CA (US)

(73) Assignee: Sonos, Inc., Santa Barbara, CA (US)

( * ) Notice: Subject to any disclaimer, the term of this patent is extended or adjusted under 35 U.S.C. 154(b) by 273 days.

(21) Appl. No.: 16/563,655

(22) Filed: Sep. 6, 2019

(65) Prior Publication Data

US 2020/0068280 A1 Feb. 27, 2020

Related U.S. Application Data

(63) Continuation of application No. 15/283,243, filed on Sep. 30, 2016, now Pat. No. 10,412,473.

(51) Int. Cl.
*H04R 25/00* (2006.01)
*H04R 1/02* (2006.01)
(Continued)

(52) U.S. Cl.
CPC ..... *H04R 1/023* (2013.01); *H04R 1/26* (2013.01); *H04R 27/00* (2013.01); *H04R 2227/003* (2013.01); *H04R 2227/005* (2013.01)

(58) Field of Classification Search
CPC ..... H04R 9/0271; H04R 1/028; H04R 1/023; H04R 27/00; H04R 2420/07;
(Continued)

(56) References Cited

U.S. PATENT DOCUMENTS 3,086,078 A 4/1963 Sharma
3,811,532 A 5/1974 Everitt
(Continued)

FOREIGN PATENT DOCUMENTS

CN 302510465 S 7/2013
CN 302760226 S 3/2014
(Continued)

OTHER PUBLICATIONS

"Dotty circle plain stamp 3.5cm", Stampingallday.co.uk, Oct. 10, 2014, retrieved from http://web.archive.org/web/20141010142137/http://stampingallday.co.uk/stampingalldayshopfront/prod_3161905-Dotty-circle-plain-stamp-35cm.html on Jun. 6, 2018, 2 pgs.
(Continued)

*Primary Examiner* — Amir H Etesam
(74) *Attorney, Agent, or Firm* — KPPB LLP

(57) ABSTRACT

A grill cover that fits over or is positioned over high frequency acoustical regions and low frequency acoustical regions of a playback device. A portion of the grill cover that fits over or is positioned over a high frequency acoustical region has small area openings and a portion of the grill over a low frequency acoustical region has large area openings. In portions of the grill cover between the portions over high and low frequency acoustical regions, the openings may have an intermediate area to visually blur the differences between the portions of the grill covers. To further blur the differences, the differently sized openings may be interleaved.

16 Claims, 16 Drawing Sheets

(51) Int. Cl.
*H04R 1/26* (2006.01)
*H04R 27/00* (2006.01)

(58) Field of Classification Search
CPC ..... H04R 17/005; H04R 1/06; H04R 1/1075; H04R 9/045; H04R 11/02; H04R 9/025
See application file for complete search history.

(56) References Cited

U.S. PATENT DOCUMENTS 3,941,638 A 3/1976 Horky et al.
4,030,563 A 6/1977 Zinna
4,064,365 A 12/1977 Zeller
4,244,096 A 1/1981 Kashichi
4,418,248 A * 11/1983 Mathis ..... H04R 1/26 381/190
4,441,577 A 4/1984 Kurihara
D330,202 S 10/1992 Adiwono
D355,962 S 2/1995 Chiu et al.
5,400,413 A 3/1995 Kindel
5,519,572 A 5/1996 Luo
5,604,663 A 2/1997 Shin et al.
5,646,820 A 7/1997 Honda et al.
5,682,290 A 10/1997 Markow et al.
D397,115 S 8/1998 Gremchuck
D401,583 S 11/1998 Shin et al.
6,035,962 A 3/2000 Lin
D425,033 S 5/2000 Hibino
6,147,859 A 11/2000 Abboud
6,278,789 B1 8/2001 Potter
6,349,792 B1 2/2002 Smith et al.
D461,791 S 8/2002 Ma
D462,065 S 8/2002 Silverstein et al.
6,522,763 B2 2/2003 Burleson et al.
D473,209 S 4/2003 Solland
D480,383 S 10/2003 Bolton et al.
6,634,615 B1 10/2003 Bick et al.
D482,344 S 11/2003 Green
D484,484 S 12/2003 Green
6,671,171 B1 12/2003 Homer et al.
D486,817 S 2/2004 Matsuoka
D489,051 S 4/2004 Shiraki et al.
D498,742 S 11/2004 Green
D508,041 S 8/2005 Carbone et al.
6,955,606 B2 10/2005 Taho et al.
D512,988 S 12/2005 Green
D513,617 S 1/2006 Tierney
D514,090 S 1/2006 Carbone et al.
D514,588 S 2/2006 Sassano
D521,495 S 5/2006 Sogabe
D522,531 S 6/2006 Solomon et al.
D527,252 S 8/2006 Bolt et al.
D537,070 S 2/2007 Warden
D538,259 S 3/2007 Okamura et al.
D538,260 S 3/2007 Wada
D542,288 S 5/2007 Andre et al.
D555,170 S 11/2007 Dai
D556,775 S 12/2007 Imai
D557,257 S 12/2007 Azumi
D559,197 S 1/2008 Lim et al.
D560,655 S 1/2008 Carbone et al.
D560,656 S 1/2008 Andre et al.
D563,386 S 3/2008 Foster
D567,254 S 4/2008 Lee
D574,849 S 8/2008 Chen
D576,637 S 9/2008 Gofman et al.
D577,742 S 9/2008 Zhang et al.
D578,105 S 10/2008 Komiyama
D580,911 S 11/2008 Andre et al.
D582,429 S 12/2008 Kusano et al.
D590,812 S 4/2009 Muraoka et al.
D594,029 S 6/2009 Gofman et al.
D594,875 S 6/2009 Sheba et al.
D595,733 S 7/2009 Harper et al.
D596,626 S 7/2009 Andre et al.
D598,020 S 8/2009 Lu et al.
D599,814 S 9/2009 Ogura et al.
D600,237 S 9/2009 Kwon et al.
D601,133 S 9/2009 Ohori
D602,430 S 10/2009 Green et al.
D609,718 S 2/2010 Chang et al.
D615,556 S 5/2010 Yeo et al.
D618,203 S 6/2010 Bradford
D622,710 S 8/2010 Goransson
D626,111 S 10/2010 Jun
D629,827 S 12/2010 Morenstein et al.
D633,503 S 3/2011 Bo et al.
D641,628 S 7/2011 Baughman
D648,743 S 11/2011 Chang
D650,394 S 12/2011 Seoc et al.
D651,994 S 1/2012 Lundbom et al.
D654,476 S 2/2012 Weitgasser
D655,276 S 3/2012 Joseph
D655,305 S 3/2012 Koo et al.
D659,670 S 5/2012 Goetzen et al.
D660,284 S 5/2012 Carbone
8,234,395 B2 7/2012 Millington
D665,161 S 8/2012 Leifeld et al.
D671,909 S 12/2012 Choi
D672,748 S 12/2012 Kallai et al.
D674,778 S 1/2013 Skurdal
D674,779 S 1/2013 Joseph
D675,190 S 1/2013 Nylen
D677,245 S 3/2013 Joseph
D680,070 S 4/2013 Zaslavsky
D681,009 S 4/2013 Meng et al.
D684,948 S 6/2013 Burlingame et al.
D685,348 S 7/2013 Szymanski et al.
D685,655 S 7/2013 Hsu
D688,231 S 8/2013 Nishii
D690,287 S 9/2013 Belfanti et al.
D692,859 S 11/2013 Ohashi
D692,860 S 11/2013 Paterson
D693,329 S 11/2013 Lee et al.
D695,711 S 12/2013 Szymanski et al.
D700,692 S 3/2014 Engelhardt
D705,192 S 5/2014 Martin et al.
D707,203 S 6/2014 Xie et al.
D707,667 S 6/2014 Kono et al.
D710,205 S 8/2014 Moretti
D710,328 S 8/2014 Kim
D711,354 S 8/2014 Florczak et al.
D713,405 S 9/2014 Akana et al.
D715,257 S 10/2014 Son et al.
D715,258 S 10/2014 Cheney et al.
D715,259 S 10/2014 Han et al.
D715,768 S 10/2014 Ryu et al.
D716,756 S 11/2014 Kim et al.
D718,737 S 12/2014 Shadovitz
D719,846 S 12/2014 Marmus
D719,931 S 12/2014 Wang
D721,061 S 1/2015 Burlingame et al.
D721,352 S 1/2015 Kusano et al.
D723,480 S 3/2015 Lee et al.
D727,360 S 4/2015 Peng et al.
D728,524 S 5/2015 Cho
D732,079 S 6/2015 Xin
D739,380 S 9/2015 Bolton
D740,787 S 10/2015 Jang et al.
9,166,273 B2 10/2015 van Niekerk
9,195,432 B2 11/2015 Reilly
D744,541 S 12/2015 Langhammer et al.
D745,488 S 12/2015 Lee et al.
D746,253 S 12/2015 Fishman
D746,338 S 12/2015 Kim et al.
9,223,353 B2 12/2015 Calatayud et al.
D746,795 S 1/2016 Burlingame et al.
9,232,288 B2 1/2016 Lien et al.
D751,056 S 3/2016 Huang et al.
D752,550 S 3/2016 Lee
9,298,415 B2 3/2016 Griffiths et al.
D753,628 S 4/2016 McManigal
D755,762 S 5/2016 Moon
D756,330 S 5/2016 Silvera
9,343,818 B2 5/2016 Chen et al.

(56) References Cited

U.S. PATENT DOCUMENTS

| | | | |
|---|---|---|---|
| D758,345 | S | 6/2016 | Fujioka |
| D759,629 | S | 6/2016 | Kusano et al. |
| 9,376,051 | B1 | 6/2016 | Mckenna |
| D762,621 | S | 8/2016 | Bolton |
| D763,818 | S | 8/2016 | Yang |
| D764,440 | S | 8/2016 | Xin |
| D766,984 | S | 9/2016 | Chatterjee et al. |
| D768,602 | S | 10/2016 | Reichert et al. |
| D769,213 | S | 10/2016 | Mcmanigal |
| D770,534 | S | 11/2016 | Thissen |
| D771,142 | S | 11/2016 | Langhammer et al. |
| D771,598 | S | 11/2016 | Gattinger et al. |
| D776,639 | S | 1/2017 | Carbone |
| D776,644 | S | 1/2017 | Kim et al. |
| D778,259 | S | 2/2017 | Bouroullec et al. |
| D778,956 | S | 2/2017 | Langhammer et al. |
| D780,728 | S | 3/2017 | Shin et al. |
| D781,263 | S | 3/2017 | Tong |
| D781,264 | S | 3/2017 | Kim et al. |
| D781,918 | S | 3/2017 | Langhammer et al. |
| D782,440 | S | 3/2017 | Holzer |
| D789,990 | S | 6/2017 | Bird et al. |
| D789,991 | S | 6/2017 | Bird et al. |
| D790,508 | S | 6/2017 | Lewis et al. |
| D792,397 | S | 7/2017 | Ma et al. |
| D794,019 | S | 8/2017 | Kusano et al. |
| D796,480 | S | 9/2017 | Sung et al. |
| D797,073 | S | 9/2017 | Yoon et al. |
| D797,808 | S | 9/2017 | Peng et al. |
| D799,445 | S | 10/2017 | Carbone |
| D800,696 | S | 10/2017 | Tubis et al. |
| D802,760 | S | 11/2017 | Neby |
| D803,187 | S | 11/2017 | Gunnarsson et al. |
| D803,265 | S | 11/2017 | Spindler |
| D806,678 | S | 1/2018 | Reichert et al. |
| D807,325 | S | 1/2018 | Ohmachi |
| D808,928 | S | 1/2018 | Schaal et al. |
| D809,481 | S | 2/2018 | McManigal |
| D813,222 | S | 3/2018 | Driscoll et al. |
| D815,062 | S | 4/2018 | Bird et al. |
| D816,057 | S | 4/2018 | Jue |
| D824,349 | S | 7/2018 | Kim et al. |
| D827,671 | S | 9/2018 | Nam et al. |
| D828,856 | S | 9/2018 | Langhammer et al. |
| D829,687 | S | 10/2018 | Burlingame et al. |
| D830,343 | S | 10/2018 | Fustino |
| D831,612 | S | 10/2018 | Usuru |
| D831,646 | S | 10/2018 | Kusano et al. |
| D832,242 | S | 10/2018 | Kwak et al. |
| 10,101,792 | B2 | 10/2018 | Calatayud et al. |
| D833,414 | S | 11/2018 | Brennan et al. |
| D835,604 | S | 12/2018 | Liao |
| D837,182 | S | 1/2019 | Elmieh et al. |
| D837,733 | S | 1/2019 | Bai |
| D839,870 | S | 2/2019 | Akana et al. |
| 10,209,948 | B2 | 2/2019 | Morganstern et al. |
| D842,271 | S | 3/2019 | Kusano et al. |
| D844,592 | S | 4/2019 | Huang |
| D848,399 | S | 5/2019 | Burlingame et al. |
| D851,057 | S | 6/2019 | Nam |
| D853,349 | S | 7/2019 | Milstead et al. |
| D853,983 | S | 7/2019 | Sarvis et al. |
| D855,587 | S | 8/2019 | Reichert et al. |
| 10,412,473 | B2 | 9/2019 | Nam et al. |
| D881,845 | S | 4/2020 | Warnhammar et al. |
| D883,956 | S | 5/2020 | Bird et al. |
| D886,765 | S | 6/2020 | Wilberding et al. |
| D886,789 | S | 6/2020 | Huang |
| D886,790 | S | 6/2020 | Yang |
| D906,278 | S | 12/2020 | Laine et al. |
| D920,278 | S | 5/2021 | Wilberding et al. |
| D921,611 | S | 6/2021 | Bird et al. |
| D924,832 | S | 7/2021 | Nam |
| 2003/0193654 | A1 | 10/2003 | Ushinski |
| 2006/0014431 | A1 | 1/2006 | Shuey et al. |
| 2011/0311083 | A1 | 12/2011 | Bennett |
| 2012/0300962 | A1 | 11/2012 | Devoto |
| 2013/0016870 | A1 | 1/2013 | Chen et al. |
| 2014/0277639 | A1 | 9/2014 | Gomes-Casseres et al. |
| 2014/0277651 | A1 | 9/2014 | Gomes-Casseres et al. |
| 2014/0355806 | A1 | 12/2014 | Graff |
| 2015/0036858 | A1 | 2/2015 | Aboabdo |
| 2015/0091764 | A1 | 4/2015 | Hsieh et al. |
| 2015/0195635 | A1 | 7/2015 | Garfio et al. |
| 2017/0055066 | A1 | 2/2017 | Chamness et al. |
| 2017/0085972 | A1 | 3/2017 | Reichert et al. |
| 2018/0098140 | A1 | 4/2018 | Nam et al. |
| 2018/0224937 | A1 | 8/2018 | Majkowski |
| 2019/0065139 | A1 | 2/2019 | Griffiths et al. |
| 2019/0069064 | A1 | 2/2019 | Ott et al. |
| 2020/0304914 | A1* | 9/2020 | Mata Magana ..... H04R 1/025 |

FOREIGN PATENT DOCUMENTS

| | | | |
|---|---|---|---|
| CN | 303773511 | S | 8/2016 |
| CN | 303931240 | S | 11/2016 |
| CN | 303931240 | S8 | 11/2016 |
| CN | 304641898 | S | 5/2018 |
| CN | 304800404 | S | 9/2018 |
| CN | 304881238 | S | 11/2018 |
| CN | 305381024 | S | 10/2019 |
| CN | 305419372 | S | 11/2019 |
| EM | 002296566-0001 | | 3/2014 |
| EM | 002836353-0001 | | 10/2015 |
| EM | 002836353-0002 | | 10/2015 |
| EM | 002836353-0003 | | 10/2015 |
| EM | 002836353-0004 | | 10/2015 |
| EM | 002836353-0005 | | 10/2015 |
| EM | 002836353-0006 | | 10/2015 |
| EM | 002836353-0007 | | 10/2015 |
| EM | 002836353-0008 | | 10/2015 |
| EM | 002836353-0009 | | 10/2015 |
| EM | 002836353-0010 | | 10/2015 |
| EM | 002836353-0011 | | 10/2015 |
| EM | 002836353-0012 | | 10/2015 |
| EM | 002836353-0013 | | 10/2015 |
| EM | 002836353-0014 | | 10/2015 |
| EM | 002836353-0015 | | 10/2015 |
| EM | 002836353-0016 | | 10/2015 |
| EM | 002836353-0017 | | 10/2015 |
| EM | 002836353-0018 | | 10/2015 |
| EM | 002836353-0022 | | 10/2015 |
| EM | 002836353-0023 | | 10/2015 |
| EM | 002836353-0024 | | 10/2015 |
| EM | 002836353-0025 | | 10/2015 |
| EM | 002836353-0026 | | 10/2015 |
| EM | 002836353-0019 | | 3/2016 |
| EM | 002836353-0020 | | 3/2016 |
| EM | 002836353-0021 | | 3/2016 |
| EM | 002836353-0027 | | 3/2016 |
| EM | 003522630-0001 | | 12/2016 |
| EM | 004315505-0001 | | 9/2017 |
| EM | 004315505-0002 | | 9/2017 |
| EM | 004315505-0003 | | 9/2017 |
| EM | 004315505-0004 | | 9/2017 |
| EM | 004315505-0005 | | 9/2017 |
| EM | 004315505-0006 | | 9/2017 |
| EM | 004315505-0007 | | 9/2017 |
| EM | 004315505-0008 | | 9/2017 |
| EM | 004315505-0009 | | 9/2017 |
| EM | 004315505-0010 | | 9/2017 |
| EM | 004315505-0011 | | 9/2017 |
| EM | 005133626-0001 | | 3/2018 |
| EM | 005133626-0002 | | 3/2018 |
| EM | 005133626-0003 | | 3/2018 |
| EM | 005133626-0004 | | 3/2018 |
| EM | 005133626-0005 | | 3/2018 |
| EM | 005133626-0006 | | 3/2018 |
| EM | 005133626-0007 | | 3/2018 |
| EM | 005133626-0008 | | 3/2018 |
| EM | 005133626-0009 | | 3/2018 |
| EM | 005133626-0010 | | 3/2018 |
| EM | 005133626-0011 | | 3/2018 |
| EM | 005133626-0012 | | 3/2018 |

(56) References Cited

FOREIGN PATENT DOCUMENTS

| | | | |
|---|---|---|---|
| EM | 005133626-0013 | | 3/2018 |
| EM | 005133626-0014 | | 3/2018 |
| EM | 005133626-0015 | | 3/2018 |
| EM | 005133626-0016 | | 3/2018 |
| EM | 005133626-0017 | | 3/2018 |
| EM | 005133626-0018 | | 3/2018 |
| EM | 005133626-0019 | | 3/2018 |
| JP | 1575137 | S | 3/2017 |
| JP | 1579363 | S | 5/2017 |
| JP | 1586620 | S | 9/2017 |
| JP | 1595215 | S | 12/2017 |
| JP | 1611676 | S | 7/2018 |
| JP | 1911675 | S | 7/2018 |
| JP | 1619489 | S | 11/2018 |
| JP | 1622401 | S | 12/2018 |
| JP | 1634349 | | 5/2019 |
| JP | 1642363 | S | 9/2019 |
| JP | 1656534 | S | 3/2020 |
| JP | 1656535 | S | 3/2020 |
| JP | 1659253 | S | 4/2020 |
| JP | 1659258 | S | 4/2020 |
| JP | 1665871 | S | 7/2020 |
| JP | 1668524 | S | 9/2020 |

OTHER PUBLICATIONS

"Making Your Own Humidor", devonbuy.com, Feb. 19, 2013, retrieved from https://www.devonbuy.com/making-your-own-humidor/ on Jun. 6, 2018, 24 pgs.

"Sonos Play: 5 Wireless Speaker Review", YouTube online, post date Jan. 1, 2016.

"ValueBasket.com", Pioneer Wireless Speaker, Jun. 26, 2012, Retrieved from: http://www.valuebasket.com/blog/wp-content/uploads/2013/07/Pioneer-Wireless.jpg on Sep. 22, 2015, 1 pg.

"XIKAR PuroTemp Round Hygrometer 832XI", NeptuneCigar.com, Dec. 2013, retrieved from https://www.neptunecigar.com/hygrometers/xikar-purotemp-digital-hygrometer-round on Jun. 6, 2018, 2 pgs.

"XW-SMA1 Large", Pioneer Electronics, Jun. 26, 2012, Retrieved from http://www.pioneerelectronics.com/StaticFiles/PUSA/Images/Product%20Images/Home/XW-SMA1_large.jpg on Sep. 22, 2015, 1 pg.

Ali Express, "KADAER Cylinder Mini", 2013, retrieved from http://www.aliexpress.com/store/group/audio/113449_211742368.html on Feb. 25, 2013, 2 pages.

Billboard Staff, "Beats by Dre Debuts First Post-Monster Cable Products", Billboard, Oct. 16, 2012, retrieved from https://www.billboard.com/biz/articles/news/1083371/beats-by-dre-debuts-first-post-monster-cable-products on Mar. 23, 2018, 3 pages.

Calore, "The Beats Pill Speaker Gets an Apple-Flavored Redesign", WIRED, Oct. 7, 2015, retrieved from https://www.wired.com/2015/10/beats-pill-plus/ on Mar. 23, 2018, 7 pages.

CNET Reviews, "Definitive Technology Sound Cylinder: Definitive rolls out slick Sound Cylinder Bluetooth speaker", CNET Editors' Take, Jan. 6, 2013, Yetrieved from http://reviews.cnet.com/portable-speakers/definitive-technology-sound-cylinder/4505-11313_7-35566924.html on Feb. 25, 2013, 5 pages.

Google Search, "B&W MM-1 Speakers—PC multimedia—wired", Jun. 2010, Yetrieved from [URL—see misc info for entire link] on Feb. 25, 2013, 3 pages, https://www.google.com/shopping/product/11800561382655422863?q= Bowers%20&%20Wilkins=&oq= Bowers+%26+Wil kins&gs_I=products-3 cc.3..0110.71820.76179.0.76394.16.5.0.11.11.0.129.354.4j1.5.0 ... 0.0...1ac.1.4.products-cc. DkgnKwdwrwOO&sa=X&ei=VMsnU.

Larsen, Rasmus, "LG brings Dolby Atmos to SJ9 soundbar and all 2017 OLED TVs", FlatpanelsHD, Jan. 10, 2017, 8 pages, retrieved from https://www.flatpanelshd.com/news.php?subaction=showfull&id=1484046315 on Feb. 12, 2018.

Murrell, Eric, "REVIEW: Sonos PLAY:5 Wireless Speaker", At Home in the Future, Dec. 22, 2014 retrieved from http://athomeinthefuture.com/2014/12/review-sonos-play5-wireless-speaker/ on Mar. 16, 2017, 4 pages.

Pierce, "Amazon Echo review: listen up", The Verge, retrieved from https://www.theverge.com/2015/1/19/7548059/amazon-echo-review-speaker on Jun. 6, 2018, Jan. 19, 2015, 12 pgs.

Ricker, Thomas, "Sonos Play:3 review Wireless Hi-Fi takes on AirPlay", The Verge, Oct. 12, 2011, retrieved from http://www.theverge.com/2011/10/12/2481479/sonos-play-3-review on Mar. 16, 2017, 2 pages.

Souppouris, Aaron "Sonos Play:5 review (2015): A generational leap forward", Engadget, Oct. 29, 2015, retrieved from https://www.engadget.com/2015/1 0/29/sonos-play-5-review-2015/#/ on Mar. 16, 2017, 8 pages.

Trei, Michael "RAAL Speakers fill your room with cylinders of sound", DVICE, Oct. 4, 2009, retrieved from http://www.dvice.com/archives/2009/10/raal-speakers-f.php on Feb. 25, 2013, 3 pages.

Walton, Mark "Sonos Play:5 review: The best-sounding wireless speaker syste we've ever used", ARS Technica, Nov. 8, 2015, retrieved from https://arstechnica.com/gadgets/2015/11/sonos-play5-review-the-best-sounding-wireless-speaker-system-weve-ever-used/ on Mar. 16, 2017, 6 pages.

Yamamoto, Mike "Some speakers are still firing on all cylinders", CNET Reviews, Dec. 5, 2007, retrieved from http:/fnews.cnet.com/8301-17938_105-9829130-1.html on Feb./ 25, 2013, 6 pages.

"Flexson Play:1 Desktop Stands", StoneAudio UK Ltd, Jun. 2015, 3 pgs.

Fleischmann, "This Just In . . . The Sonos Play:1", Sound & Vision, Jan. 2014, No. 1, vol. 79, p. 19.

* cited by examiner

1600

SPEAKER GRILL WITH GRADUATED HOLE SIZING OVER A TRANSITION AREA FOR A MEDIA DEVICE

CROSS-REFERENCE TO RELATED APPLICATIONS

The present application is a continuation of U.S. patent application Ser. No. 15/283,243, entitled "SPEAKER GRILL WITH GRADUATED HOLE SIZING OVER A TRANSITION AREA FOR A MEDIA DEVICE" to Nam et al., filed Sep. 30, 2016, the disclosure of which is incorporated herein by reference in its entirety.

FIELD OF THE DISCLOSURE

The disclosure is related to consumer goods and, more particularly, to methods, systems, products, features, services, and other elements directed to media playback or some aspect thereof. Media playback devices and associated features and capabilities can include those disclosed in U.S. patent application Ser. No. 29/579,640 entitled "Media Playback Device," filed Sep. 30, 2016, U.S. patent application Ser. No. 29/579,643 entitled "Speaker Grill with Graduated Hole Sizing over a Transition Area for a Media Device," filed Sep. 30, 2016, U.S. patent application Ser. No. 14/831,903 entitled "Manipulation of Playback Device Response Using an Acoustic Filter," filed Aug. 21, 2015, the disclosure from which relevant to media playback devices is hereby incorporated by reference in its entirety.

BACKGROUND

Options for accessing and listening to digital audio in an out-loud setting were limited until in 2003, when SONOS, Inc. filed for one of its first patent applications, entitled "Method for Synchronizing Audio Playback between Multiple Networked Devices," and began offering a media playback system for sale in 2005. The Sonos Wireless HiFi System enables people to experience music from many sources via one or more networked playback devices. Through a software control application installed on a smartphone, tablet, or computer, one can play what he or she wants in any room that has a networked playback device. Additionally, using the controller, for example, different songs can be streamed to each room with a playback device, rooms can be grouped together for synchronous playback, or the same song can be heard in all rooms synchronously.

Given the ever-growing interest in digital media, there continues to be a need to develop consumer-accessible technologies to further enhance the listening experience.

BRIEF DESCRIPTION OF THE DRAWINGS

Features, aspects, and advantages of the presently disclosed technology may be better understood with regard to the following description, appended claims, and accompanying drawings where:

Figure 1:
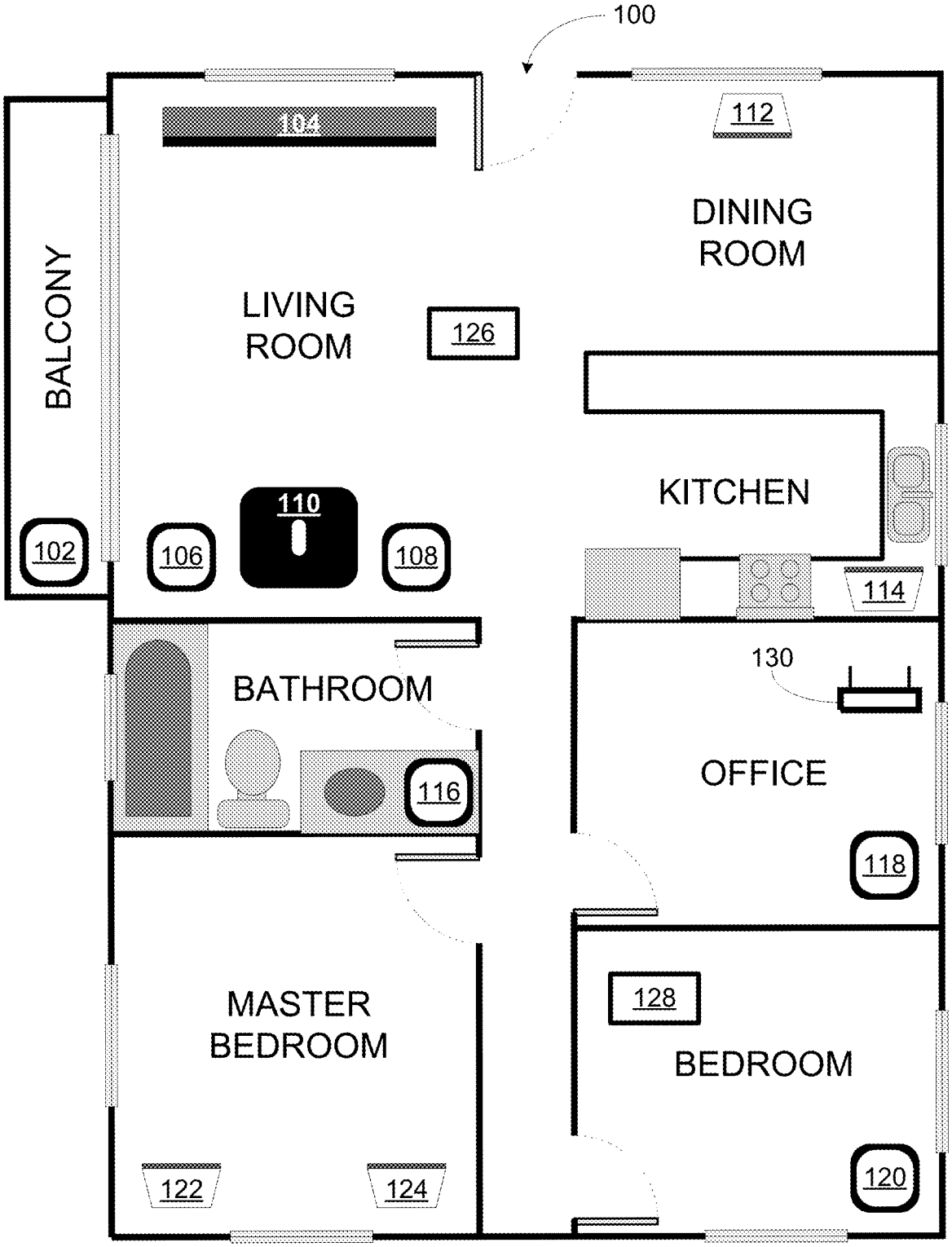
FIG. 1 shows an example media playback system configuration in which certain embodiments may be practiced.

The drawings are for the purpose of illustrating example embodiments, but it is understood that the inventions are not limited to the arrangements and instrumentality shown in the drawings.

DETAILED DESCRIPTION

I. Overview

Some embodiments described herein involve a speaker grill covering over positions or ports for the speaker in a playback device. The speaker grill cover has smaller area openings in the portion(s) of the grill that covers the positions or ports in the playback device for high frequency speakers and larger area openings in the portion(s) of the grill that covers the positions or ports in the playback device for low frequency speakers. In addition, the speaker grill may have openings of one or more intermediate area sizes between the smaller and larger area openings such that the transition between the opening sizes appear less abrupt. This may result in a more aesthetically pleasing grill covering. Furthermore, interface areas between different sizes of openings may have interleaved or uneven rows to obfuscate the transition from one size of openings to another size.

In accordance with some particular embodiments, a playback device housing has positions or speaker ports for high frequency speakers along a front surface and positions or speaker ports for low frequency speakers along opposing side surfaces. In some embodiments, a speaker grill cover fits over the portions of front and side surfaces of the playback device housing and wraps around the intersecting corners. The portions of the speaker grill cover that fit over the front surface of the housing has the smaller area openings that cover high frequency speakers and the portions of the grill covering that fit over the sides of the housing have the larger size openings that cover the ports for low frequency speakers. The portions of the grill that wrap around the housing or fit over the corners are transition areas include opening of one or more intermediate size to make the grill appear more uniform to an observer. In addition, at the boundaries of portions having different sized openings, the different sized openings may be interleaved to obfuscate the transition. In many embodiments, the interleaving may be accomplished by interlacing rows of a first size of openings with the rows of a second size of openings.

In one aspect, a grill cover for a playback device is provided. The grill cover is comprised of a body having a first portion and a second portion. The first portion of the body fits over a high frequency acoustical region of the playback device and defines a first set openings through the body. Each of the plurality of openings in the first portion has a small area configured to relieve a low airflow induced in the high frequency acoustical region. The second portion of the body fits over a low frequency acoustical region of the playback device and defines a second set of openings through the body. Each of the second set of openings is sized to have a large area than is larger than the small area to relieve a high airflow induced by the low frequency acoustical region.

In a second aspect, the body of the grill cover includes a third portion that is between the first portion and the second portion and fits over an acoustically insignificant region of the playback device and defines a third set of openings. Each of the third set of openings are sized to have a first intermediate area that is greater than the small area and less than the large area. In many of these embodiments, the third portion defines a number of openings that are sized to have the small area and/or the large area that are interleaved with the third set of openings in the third portion. In several embodiments, the third portion of the body defines a fourth set of openings. Each of the fourth set of openings are sized to a second intermediate area that is greater than the small area and less than the large area. In a number of these embodiments, the third set of openings and the fourth set of openings are interleaved.

In some embodiments, the third portion of the body is proximate a visual distraction associated with the playback device. In some embodiments, the third portion is a different color from at least one of the first and second portions of the body.

In another aspect, a method of manufacture of a grill cover is provided. In the method, a body of the grill is formed. A first set of openings is defined through a first portion of the body that fits over a high frequency acoustical region of the playback device. Each of first set of openings has a small area configured to relieve a low airflow induced in the high frequency acoustical region. A second set of openings is defined through a second portion of the body that fits over a low frequency acoustical region of the playback device. Each of the second set of openings is sized to have a large area than is larger than the small area to relieve a high airflow induced by the low frequency acoustical region.

In some embodiments, a third set of openings is defined through a third portion of the body that is between the first portion and the second portion and fits over an acoustically insignificant region of the playback device. Each of the third set of openings is sized to have a first intermediate area that is greater than the small area and less than the large area.

While some examples described herein may refer to functions performed by given actors such as "users" and/or other entities, it should be understood that this is for purposes of explanation only. The claims should not be interpreted to require action by any such example actor unless explicitly required by the language of the claims themselves. It will be understood by one of ordinary skill in the art that this disclosure includes numerous other embodiments.

II. Example Operating Environment

FIG. 1 shows an example configuration of a media playback system 100 in which one or more embodiments disclosed herein may be practiced or implemented. The media playback system 100 as shown is associated with an example home environment having several rooms and spaces, such as for example, a master bedroom, an office, a dining room, and a living room. As shown in the example of FIG. 1, the media playback system 100 includes playback devices 102-124, control devices 126 and 128, and a wired or wireless network router 130.

Further discussions relating to the different components of the example media playback system 100 and how the different components may interact to provide a user with a media experience may be found in the following sections. While discussions herein may generally refer to the example media playback system 100, technologies described herein are not limited to applications within, among other things, the home environment as shown in FIG. 1. For instance, the technologies described herein may be useful in environments where multi-zone audio may be desired, such as, for example, a commercial setting like a restaurant, mall or airport, a vehicle like a sports utility vehicle (SUV), bus or car, a ship or boat, an airplane, and so on.

a. Example Playback Devices

Figure 2:
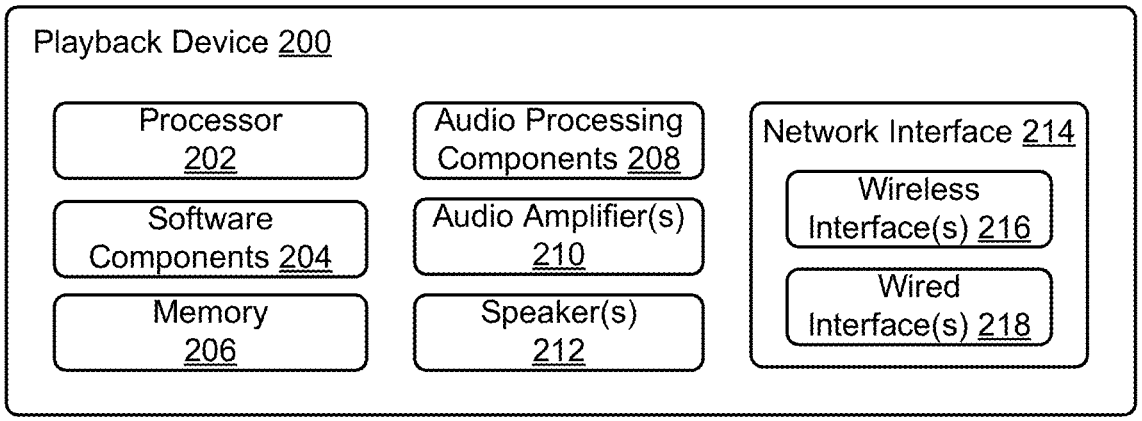
FIG. 2 shows a functional block diagram of an example playback device.

FIG. 2 shows a functional block diagram of an example playback device 200 that may be configured to be one or more of the playback devices 102-124 of the media playback system 100 of FIG. 1. The playback device 200 may include a processor 202, software components 204, memory 206, audio processing components 208, audio amplifier(s) 210, speaker(s) 212, and a network interface 214 including wireless interface(s) 216 and wired interface(s) 218. In one case, the playback device 200 may not include the speaker(s) 212, but rather a speaker interface for connecting the playback device 200 to external speakers. In another case, the playback device 200 may include neither the speaker(s) 212 nor the audio amplifier(s) 210, but rather an audio interface for connecting the playback device 200 to an external audio amplifier or audio-visual receiver.

In one example, the processor 202 may be a clock-driven computing component configured to process input data according to instructions stored in the memory 206. The memory 206 may be a tangible computer-readable medium configured to store instructions executable by the processor 202. For instance, the memory 206 may be data storage that can be loaded with one or more of the software components 204 executable by the processor 202 to achieve certain functions. In one example, the functions may involve the playback device 200 retrieving audio data from an audio source or another playback device. In another example, the functions may involve the playback device 200 sending audio data to another device or playback device on a network. In yet another example, the functions may involve pairing of the playback device 200 with one or more playback devices to create a multi-channel audio environment.

Certain functions may involve the playback device 200 synchronizing playback of audio content with one or more other playback devices. During synchronous playback, a listener will preferably not be able to perceive time-delay differences between playback of the audio content by the playback device 200 and the one or more other playback devices. U.S. Pat. No. 8,234,395 entitled, "System and method for synchronizing operations among a plurality of independently clocked digital data processing devices," which is hereby incorporated by reference, provides in more detail some examples for audio playback synchronization among playback devices.

The memory 206 may further be configured to store data associated with the playback device 200, such as one or more zones and/or zone groups the playback device 200 is a part of, audio sources accessible by the playback device 200, or a playback queue that the playback device 200 (or some other playback device) may be associated with. The data may be stored as one or more state variables that are periodically updated and used to describe the state of the playback device 200. The memory 206 may also include the data associated with the state of the other devices of the media system, and shared from time to time among the devices so that one or more of the devices have the most recent data associated with the system. Other embodiments are also possible.

The audio processing components 208 may include one or more digital-to-analog converters (DAC), an audio preprocessing component, an audio enhancement component or a digital signal processor (DSP), and so on. In one embodiment, one or more of the audio processing components 208 may be a subcomponent of the processor 202. In one example, audio content may be processed and/or intentionally altered by the audio processing components 208 to produce audio signals. The produced audio signals may then be provided to the audio amplifier(s) 210 for amplification and playback through speaker(s) 212. Particularly, the audio amplifier(s) 210 may include devices configured to amplify audio signals to a level for driving one or more of the speakers 212. The speaker(s) 212 may include an individual transducer (e.g., a "driver") or a complete speaker system involving an enclosure with one or more drivers. A particular driver of the speaker(s) 212 may include, for example, a subwoofer (e.g., for low frequencies), a mid-range driver (e.g., for middle frequencies), and/or a tweeter (e.g., for high frequencies). In some cases, each transducer in the one or more speakers 212 may be driven by an individual corresponding audio amplifier of the audio amplifier(s) 210. In addition to producing analog signals for playback by the playback device 200, the audio processing components 208 may be configured to process audio content to be sent to one or more other playback devices for playback.

Audio content to be processed and/or played back by the playback device 200 may be received from an external source, such as via an audio line-in input connection (e.g., an auto-detecting 3.5 mm audio line-in connection) or the network interface 214.

The network interface 214 may be configured to facilitate a data flow between the playback device 200 and one or more other devices on a data network. As such, the playback device 200 may be configured to receive audio content over the data network from one or more other playback devices in communication with the playback device 200, network devices within a local area network, or audio content sources over a wide area network such as the Internet. In one example, the audio content and other signals transmitted and received by the playback device 200 may be transmitted in the form of digital packet data containing an Internet Protocol (IP)-based source address and IP-based destination addresses. In such a case, the network interface 214 may be configured to parse the digital packet data such that the data destined for the playback device 200 is properly received and processed by the playback device 200.

As shown, the network interface 214 may include wireless interface(s) 216 and wired interface(s) 218. The wireless interface(s) 216 may provide network interface functions for the playback device 200 to wirelessly communicate with other devices (e.g., other playback device(s), speaker(s), receiver(s), network device(s), control device(s) within a data network the playback device 200 is associated with) in accordance with a communication protocol (e.g., any wireless standard including IEEE 802.11a, 802.11b, 802.11g, 802.11n, 802.11ac, 802.15, 4G mobile communication standard, and so on). The wired interface(s) 218 may provide network interface functions for the playback device 200 to communicate over a wired connection with other devices in accordance with a communication protocol (e.g., IEEE 802.3). While the network interface 214 shown in FIG. 2 includes both wireless interface(s) 216 and wired interface(s) 218, the network interface 214 may in some embodiments include only wireless interface(s) or only wired interface(s).

In one example, the playback device 200 and one other playback device may be paired to play two separate audio components of audio content. For instance, playback device 200 may be configured to play a left channel audio component, while the other playback device may be configured to play a right channel audio component, thereby producing or enhancing a stereo effect of the audio content. The paired playback devices (also referred to as "bonded playback devices") may further play audio content in synchrony with other playback devices.

In another example, the playback device 200 may be sonically consolidated with one or more other playback devices to form a single, consolidated playback device. A consolidated playback device may be configured to process and reproduce sound differently than an unconsolidated playback device or playback devices that are paired, because a consolidated playback device may have additional speaker drivers through which audio content may be rendered. For instance, if the playback device 200 is a playback device designed to render low frequency range audio content (i.e. a subwoofer), the playback device 200 may be consolidated with a playback device designed to render full frequency range audio content. In such a case, the full frequency range playback device, when consolidated with the low frequency playback device 200, may be configured to render only the mid and high frequency components of audio content, while the low frequency range playback device 200 renders the low frequency component of the audio content. The consolidated playback device may further be paired with a single playback device or yet another consolidated playback device.

By way of illustration, SONOS, Inc. presently offers (or has offered) for sale certain playback devices including a "PLAY:1," "PLAY:3," "PLAY:5," "PLAYBAR," "CON- NECT:AMP," "CONNECT," and "SUB." Any other past, present, and/or future playback devices may additionally or alternatively be used to implement the playback devices of example embodiments disclosed herein. Additionally, it is understood that a playback device is not limited to the example illustrated in FIG. 2 or to the SONOS product offerings. For example, a playback device may include a wired or wireless headphone. In another example, a playback device may include or interact with a docking station for personal mobile media playback devices. In yet another example, a playback device may be integral to another device or component such as a television, a lighting fixture, or some other device for indoor or outdoor use.

b. Example Playback Zone Configurations

Referring back to the media playback system 100 of FIG. 1, the environment may have one or more playback zones, each with one or more playback devices. The media playback system 100 may be established with one or more playback zones, after which one or more zones may be added, or removed to arrive at the example configuration shown in FIG. 1. Each zone may be given a name according to a different room or space such as an office, bathroom, master bedroom, bedroom, kitchen, dining room, living room, and/or balcony. In one case, a single playback zone may include multiple rooms or spaces. In another case, a single room or space may include multiple playback zones.

As shown in FIG. 1, the balcony, dining room, kitchen, bathroom, office, and bedroom zones each have one playback device, while the living room and master bedroom zones each have multiple playback devices. In the living room zone, playback devices 104, 106, 108, and 110 may be configured to play audio content in synchrony as individual playback devices, as one or more bonded playback devices, as one or more consolidated playback devices, or any combination thereof. Similarly, in the case of the master bedroom, playback devices 122 and 124 may be configured to play audio content in synchrony as individual playback devices, as a bonded playback device, or as a consolidated playback device.

In one example, one or more playback zones in the environment of FIG. 1 may each be playing different audio content. For instance, the user may be grilling in the balcony zone and listening to hip hop music being played by the playback device 102 while another user may be preparing food in the kitchen zone and listening to classical music being played by the playback device 114. In another example, a playback zone may play the same audio content in synchrony with another playback zone. For instance, the user may be in the office zone where the playback device 118 is playing the same rock music that is being playing by playback device 102 in the balcony zone. In such a case, playback devices 102 and 118 may be playing the rock music in synchrony such that the user may seamlessly (or at least substantially seamlessly) enjoy the audio content that is being played out-loud while moving between different playback zones. Synchronization among playback zones may be achieved in a manner similar to that of synchronization among playback devices, as described in previously referenced U.S. Pat. No. 8,234,395.

As suggested above, the zone configurations of the media playback system 100 may be dynamically modified, and in some embodiments, the media playback system 100 supports numerous configurations. For instance, if a user physically moves one or more playback devices to or from a zone, the media playback system 100 may be reconfigured to accommodate the change(s). For instance, if the user physically moves the playback device 102 from the balcony zone to the office zone, the office zone may now include both the playback device 118 and the playback device 102. The playback device 102 may be paired or grouped with the office zone and/or renamed if so desired via a control device such as the control devices 126 and 128. On the other hand, if the one or more playback devices are moved to a particular area in the home environment that is not already a playback zone, a new playback zone may be created for the particular area.

Further, different playback zones of the media playback system 100 may be dynamically combined into zone groups or split up into individual playback zones. For instance, the dining room zone and the kitchen zone 114 may be combined into a zone group for a dinner party such that playback devices 112 and 114 may render audio content in synchrony. On the other hand, the living room zone may be split into a television zone including playback device 104, and a listening zone including playback devices 106, 108, and 110, if the user wishes to listen to music in the living room space while another user wishes to watch television.

c. Example Control Devices

Figure 3:
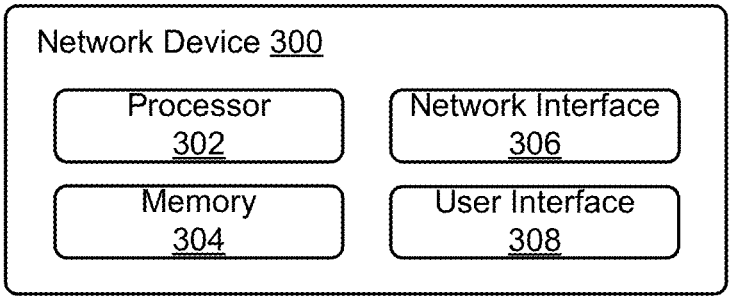
FIG. 3 shows a functional block diagram of an example control device.

FIG. 3 shows a functional block diagram of an example control device 300 that may be configured to be one or both of the control devices 126 and 128 of the media playback system 100. As shown, the control device 300 may include a processor 302, memory 304, a network interface 306, and a user interface 308. In one example, the control device 300 may be a dedicated controller for the media playback system 100. In another example, the control device 300 may be a network device on which media playback system controller application software may be installed, such as for example, an iPhone™, iPad™ or any other smart phone, tablet or network device (e.g., a networked computer such as a PC or Mac™).

The processor 302 may be configured to perform functions relevant to facilitating user access, control, and configuration of the media playback system 100. The memory 304 may be configured to store instructions executable by the processor 302 to perform those functions. The memory 304 may also be configured to store the media playback system controller application software and other data associated with the media playback system 100 and the user.

In one example, the network interface 306 may be based on an industry standard (e.g., infrared, radio, wired standards including IEEE 802.3, wireless standards including IEEE 802.11a, 802.11b, 802.11g, 802.11n, 802.11ac, 802.15, 4G mobile communication standard, and so on). The network interface 306 may provide a means for the control device 300 to communicate with other devices in the media playback system 100. In one example, data and information (e.g., such as a state variable) may be communicated between control device 300 and other devices via the network interface 306. For instance, playback zone and zone group configurations in the media playback system 100 may be received by the control device 300 from a playback device or another network device, or transmitted by the control device 300 to another playback device or network device via the network interface 306. In some cases, the other network device may be another control device.

Playback device control commands such as volume control and audio playback control may also be communicated from the control device 300 to a playback device via the network interface 306. As suggested above, changes to configurations of the media playback system 100 may also be performed by a user using the control device 300. The configuration changes may include adding/removing one or more playback devices to/from a zone, adding/removing one or more zones to/from a zone group, forming a bonded or consolidated player, separating one or more playback devices from a bonded or consolidated player, among others. Accordingly, the control device 300 may sometimes be referred to as a controller, whether the control device 300 is a dedicated controller or a network device on which media playback system controller application software is installed.

Figure 4:
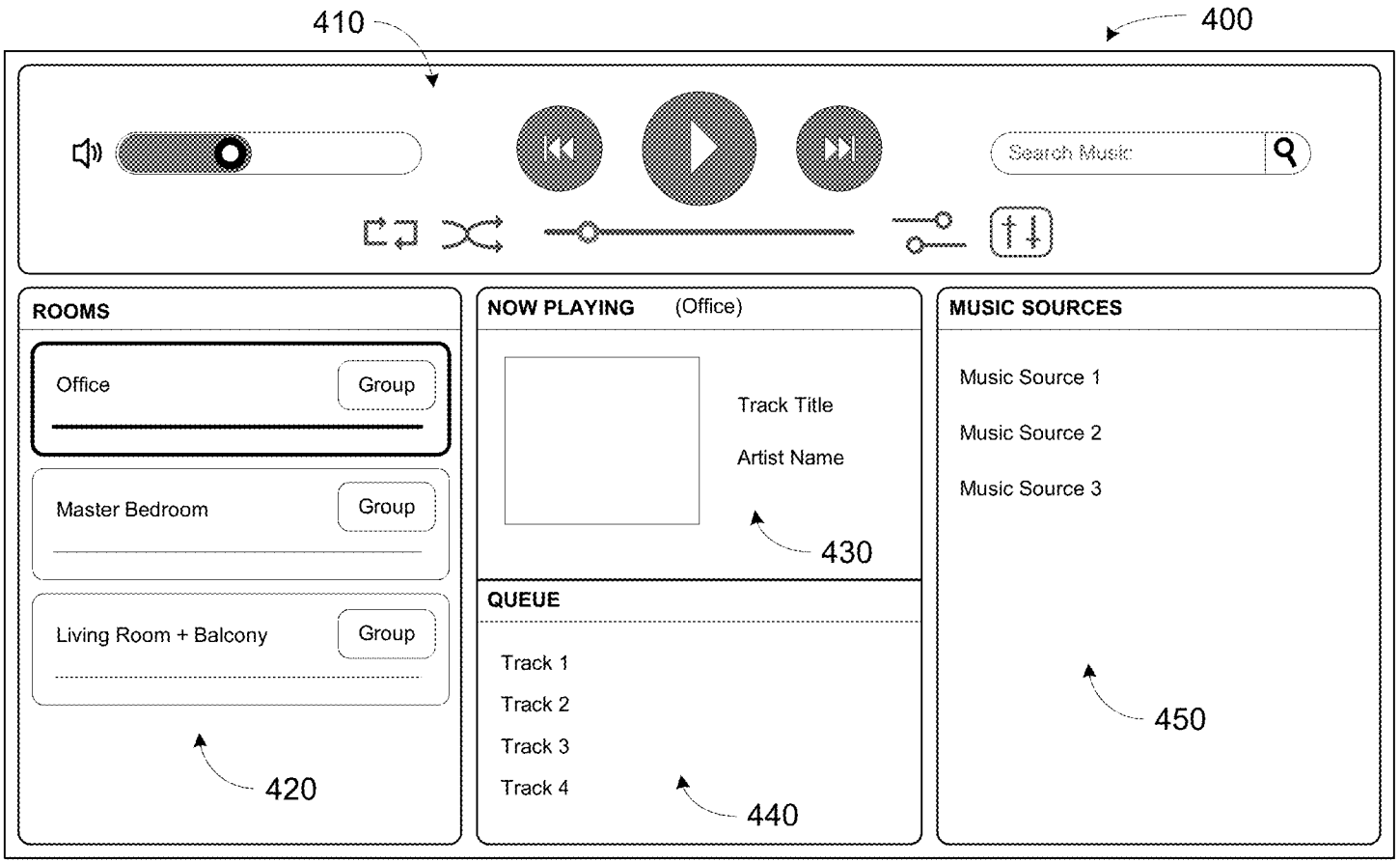
FIG. 4 shows an example controller interface.

The user interface 308 of the control device 300 may be configured to facilitate user access and control of the media playback system 100, by providing a controller interface such as the controller interface 400 shown in FIG. 4. The controller interface 400 includes a playback control region 410, a playback zone region 420, a playback status region 430, a playback queue region 440, and an audio content sources region 450. The controller interface 400 as shown is just one example of a user interface that may be provided on a network device such as the control device 300 of FIG. 3 (and/or the control devices 126 and 128 of FIG. 1) and accessed by users to control a media playback system such as the media playback system 100. Other user interfaces of varying formats, styles, and interactive sequences may alternatively be implemented on one or more network devices to provide comparable control access to a media playback system.

The playback control region 410 may include selectable (e.g., by way of touch or by using a cursor) icons to cause playback devices in a selected playback zone or zone group to play or pause, fast forward, rewind, skip to next, skip to previous, enter/exit shuffle mode, enter/exit repeat mode, enter/exit cross fade mode. The playback control region 410 may also include selectable icons to modify equalization settings, and playback volume, among other possibilities.

The playback zone region 420 may include representations of playback zones within the media playback system 100. In some embodiments, the graphical representations of playback zones may be selectable to bring up additional selectable icons to manage or configure the playback zones in the media playback system, such as a creation of bonded zones, creation of zone groups, separation of zone groups, and renaming of zone groups, among other possibilities.

For example, as shown, a "group" icon may be provided within each of the graphical representations of playback zones. The "group" icon provided within a graphical representation of a particular zone may be selectable to bring up options to select one or more other zones in the media playback system to be grouped with the particular zone. Once grouped, playback devices in the zones that have been grouped with the particular zone will be configured to play audio content in synchrony with the playback device(s) in the particular zone. Analogously, a "group" icon may be provided within a graphical representation of a zone group. In this case, the "group" icon may be selectable to bring up options to deselect one or more zones in the zone group to be removed from the zone group. Other interactions and implementations for grouping and ungrouping zones via a user interface such as the controller interface 400 are also possible. The representations of playback zones in the playback zone region 420 may be dynamically updated as playback zone or zone group configurations are modified.

The playback status region 430 may include graphical representations of audio content that is presently being played, previously played, or scheduled to play next in the selected playback zone or zone group. The selected playback zone or zone group may be visually distinguished on the user interface, such as within the playback zone region 420 and/or the playback status region 430. The graphical representations may include track title, artist name, album name, album year, track length, and other relevant information that may be useful for the user to know when controlling the media playback system via the user interface 400.

The playback queue region 440 may include graphical representations of audio content in a playback queue associated with the selected playback zone or zone group. In some embodiments, each playback zone or zone group may be associated with a playback queue containing information corresponding to zero or more audio items for playback by the playback zone or zone group. For instance, each audio item in the playback queue may comprise a uniform resource identifier (URI), a uniform resource locator (URL) or some other identifier that may be used by a playback device in the playback zone or zone group to find and/or retrieve the audio item from a local audio content source or a networked audio content source, possibly for playback by the playback device.

In one example, a playlist may be added to a playback queue, in which case information corresponding to each audio item in the playlist may be added to the playback queue. In another example, audio items in a playback queue may be saved as a playlist. In a further example, a playback queue may be empty, or populated but "not in use" when the playback zone or zone group is playing continuously streaming audio content, such as Internet radio that may continue to play until otherwise stopped, rather than discrete audio items that have playback durations. In an alternative embodiment, a playback queue can include Internet radio and/or other streaming audio content items and be "in use" when the playback zone or zone group is playing those items. Other examples are also possible.

When playback zones or zone groups are "grouped" or "ungrouped," playback queues associated with the affected playback zones or zone groups may be cleared or re-associated. For example, if a first playback zone including a first playback queue is grouped with a second playback zone including a second playback queue, the established zone group may have an associated playback queue that is initially empty, that contains audio items from the first playback queue (such as if the second playback zone was added to the first playback zone), that contains audio items from the second playback queue (such as if the first playback zone was added to the second playback zone), or a combination of audio items from both the first and second playback queues. Subsequently, if the established zone group is ungrouped, the resulting first playback zone may be re-associated with the previous first playback queue, or be associated with a new playback queue that is empty or contains audio items from the playback queue associated with the established zone group before the established zone group was ungrouped. Similarly, the resulting second playback zone may be re-associated with the previous second playback queue, or be associated with a new playback queue that is empty, or contains audio items from the playback queue associated with the established zone group before the established zone group was ungrouped. Other examples are also possible.

Referring back to the controller interface 400 of FIG. 4, the graphical representations of audio content in the playback queue region 440 may include track titles, artist names, track lengths, and other relevant information associated with the audio content in the playback queue. In one example, graphical representations of audio content may be selectable to bring up additional selectable icons to manage and/or manipulate the playback queue and/or audio content represented in the playback queue. For instance, a represented audio content may be removed from the playback queue, moved to a different position within the playback queue, or selected to be played immediately, or after any currently playing audio content, among other possibilities. A playback queue associated with a playback zone or zone group may be stored in a memory on one or more playback devices in the playback zone or zone group, on a playback device that is not in the playback zone or zone group, and/or some other designated device.

The audio content sources region 450 may include graphical representations of selectable audio content sources from which audio content may be retrieved and played by the selected playback zone or zone group. Discussions pertaining to audio content sources may be found in the following section.

d. Example Audio Content Sources

As indicated previously, one or more playback devices in a zone or zone group may be configured to retrieve for playback audio content (e.g. according to a corresponding URI or URL for the audio content) from a variety of available audio content sources. In one example, audio content may be retrieved by a playback device directly from a corresponding audio content source (e.g., a line-in connection). In another example, audio content may be provided to a playback device over a network via one or more other playback devices or network devices.

Example audio content sources may include a memory of one or more playback devices in a media playback system such as the media playback system 100 of FIG. 1, local music libraries on one or more network devices (such as a control device, a network-enabled personal computer, or a networked-attached storage (NAS), for example), streaming audio services providing audio content via the Internet (e.g., the cloud), or audio sources connected to the media playback system via a line-in input connection on a playback device or network devise, among other possibilities.

In some embodiments, audio content sources may be regularly added or removed from a media playback system such as the media playback system 100 of FIG. 1. In one example, an indexing of audio items may be performed whenever one or more audio content sources are added, removed or updated. Indexing of audio items may involve scanning for identifiable audio items in all folders/directory shared over a network accessible by playback devices in the media playback system, and generating or updating an audio content database containing metadata (e.g., title, artist, album, track length, among others) and other associated information, such as a URI or URL for each identifiable audio item found. Other examples for managing and maintaining audio content sources may also be possible.

The above discussions relating to playback devices, controller devices, playback zone configurations, and media content sources provide only some examples of operating environments within which functions and methods described below may be implemented. Other operating environments and configurations of media playback systems, playback devices, and network devices not explicitly described herein may also be applicable and suitable for implementation of the functions and methods.

III. A Playback Device Having a Speaker Grill Cover with Variably Sized Openings As discussed above, embodiments described herein may involve an audio playback device that may be used in the above-described system. In particular, an audio playback device in accordance with some embodiments of this invention includes a grill cover with variable sized openings where the sizes of the openings in a portion of a grill are determined, at least in part, by the acoustical region covered by the portion of the grill. In addition, the grill may also include transitional areas where openings of an intermediate size are placed to obfuscate the transitions between larger and smaller sized openings.

In general, a speaker grill cover is often designed to optimize for constraints in the acoustics, aesthetics, and mechanics of the system. Acoustical constraints can include minimizing unwanted noise due to turbulence created by the grill, maximizing acoustic transparency, and optimizing full-spectrum polar response of the overall speaker system. Aesthetical constraints can include making the grill cover look as solid as possible, minimizing visibility of objects behind the cover, and minimizing the visibility of any changes in opening sizes across different areas. Mechanical constraints can include maintaining a minimum distance between openings to prevent breakage that is dependent on the grill material, the thickness of the material, and the method of manufacture.

Figure 5:
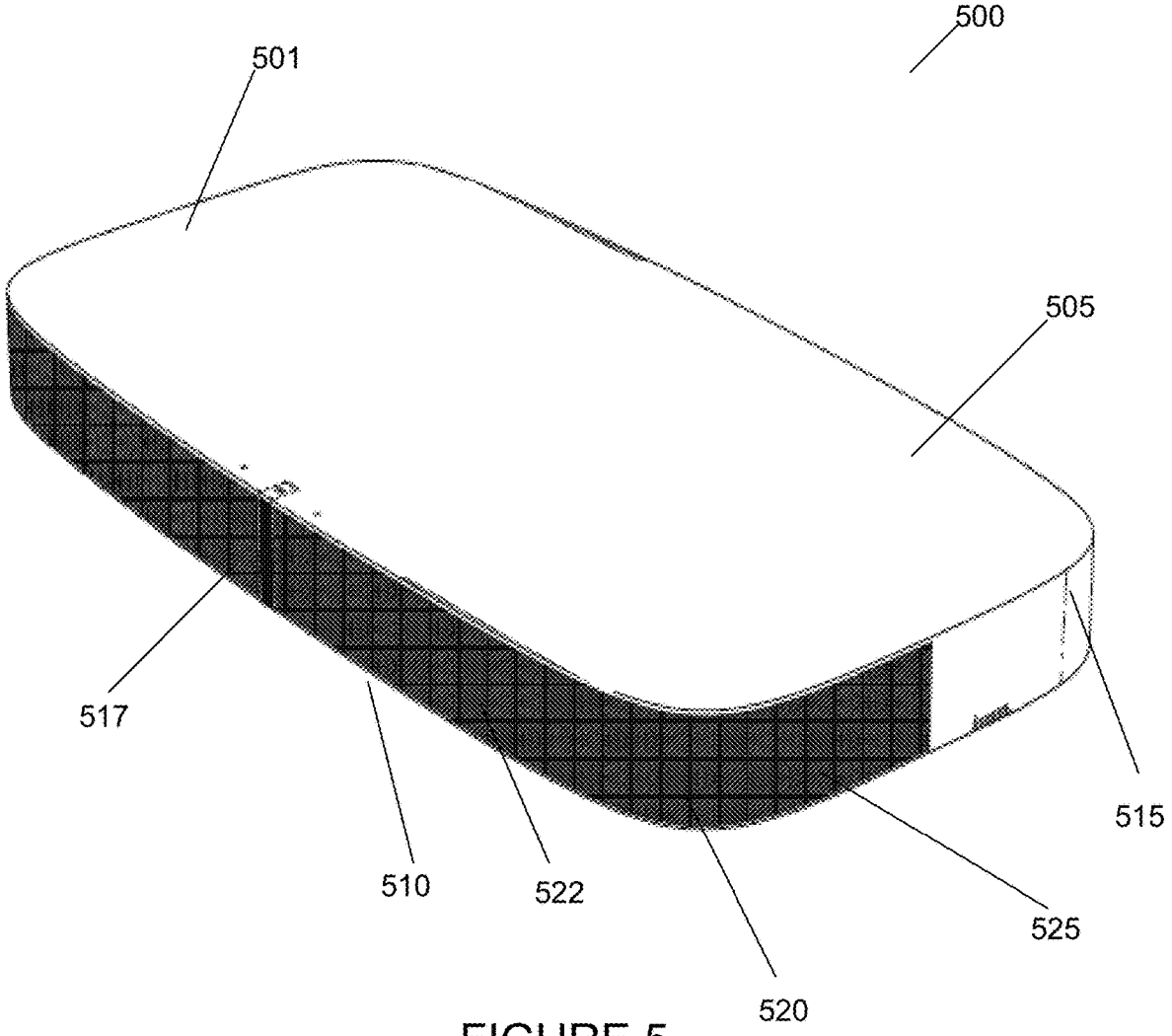
FIG. 5 shows a front perspective view of an audio playback system in accordance with an embodiment of the invention.
Figure 6:
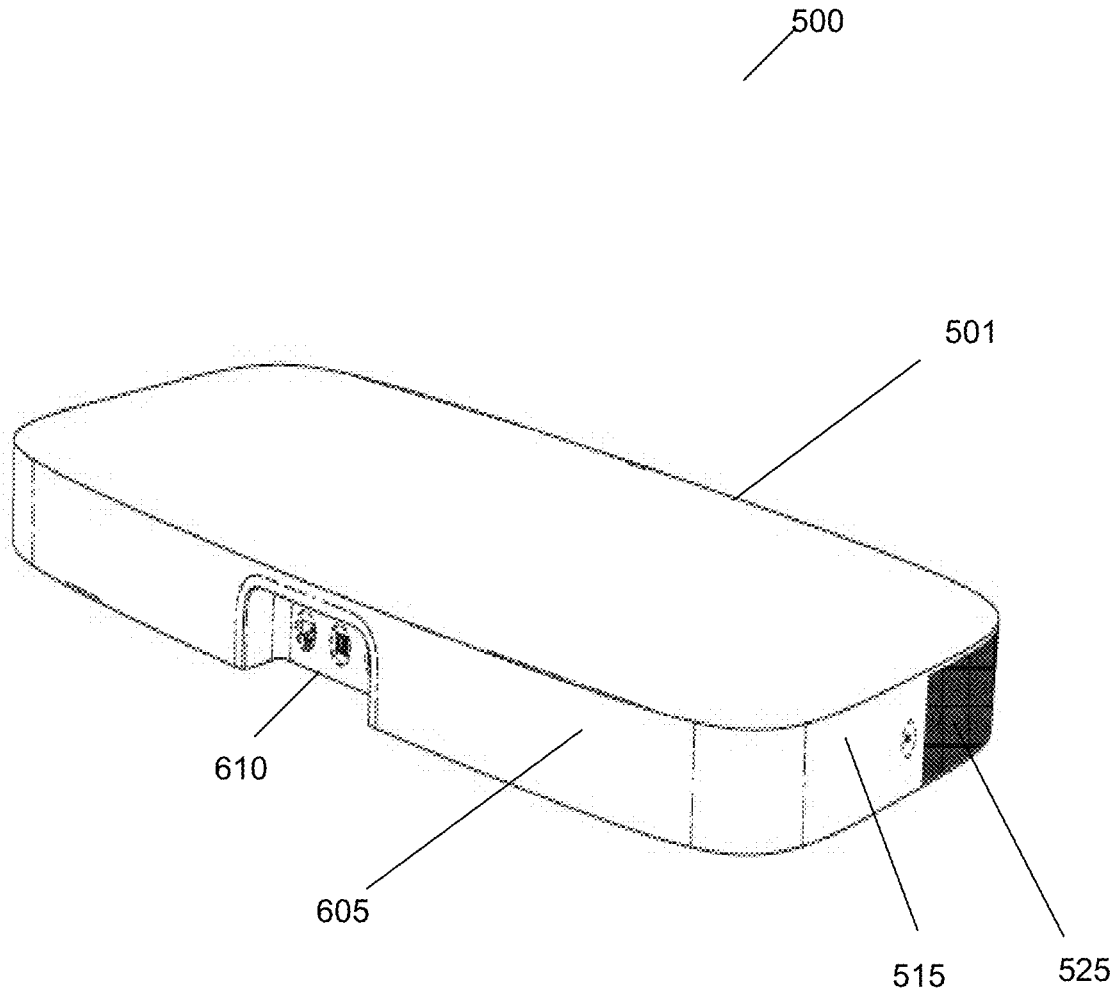
FIG. 6 shows a back perspective view of an audio playback system in accordance with an embodiment of the invention.

For purposes of this discussion, an acoustical region is an area that has certain acoustical characteristics due to the acoustical equipment present in the area. For example, acoustical regions with equipment that generates low frequency sounds typically generates higher airflow and require larger openings to minimize turbulence from air passing from the region through the grill. Acoustical regions with equipment that generates high frequency sounds, on the other hand, typically generates lower airflow and do not require such large openings. Generally, the opening size in a portion of a grill over a region is determined to keep the acoustic resistance below a certain threshold based on the following relationship:

$$R \sim \frac{L}{A^2}$$

Where R is the acoustic resistance; L is the length of the opening (thickness of the grill) and A is the total area of the opening over the acoustic region (total area of all openings over the region). A grill cover for a playback device having variably sized openings in accordance with some embodiments of the invention is designed to the above-identified criteria. An example of a playback device in accordance with an embodiment of the invention is shown in FIGS. 5 and 6.

Playback device 500 has a housing 501 that encloses the control and acoustic equipment used to provide the audio playback. The housing 501 has a top side 505, a front side 510, opposing end sides 515, and a rear side 605. A speaker grill cover 517 fits over the entirety of front side 510 and wraps around to cover at least a portion 525 of opposing sides 515. Speaker grill cover 517 is a continuous cover with wrap-around portions 520 that bend to fit over the corners between front side 510 and an opposing sides 515.

Figure 7:
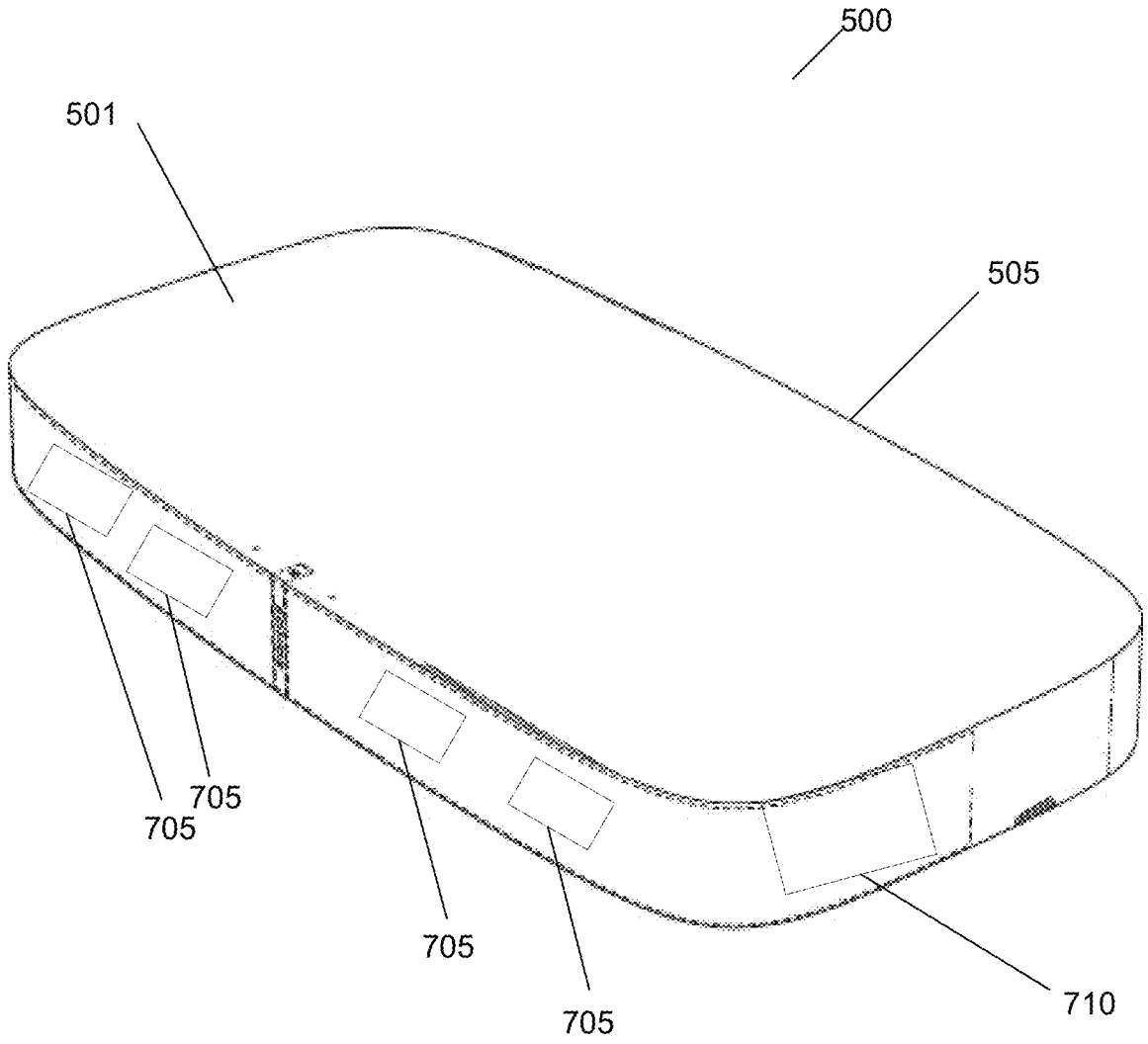
FIG. 7 shows a front perspective view of an audio playback system in accordance with an embodiment of the invention.

A view of housing 501 in accordance with an embodiment of the invention with the speaker grill cover 517 removed is shown in FIG. 7. The housing 501 includes high frequency acoustic regions 705 and low frequency acoustical regions 710. High frequency regions 705 typically have a lobed polar response in the direction of orientation of a transducer (or horn). As such, high frequency acoustical regions 705 are positioned on the front side 510 of housing 501 so that the direction of orientation of the transducers is substantially perpendicular with front side 510 and acoustic waves propagating from the transducers travel along the direction of orientation. The low frequency acoustical regions 710 typically have substantially round polar patterns and often do not need to be oriented in a direction of dispersion. As such, low frequency acoustical regions 710 are positioned on opposing sides 515 of housing 501. The position of the low frequency acoustical regions also aids in causing any noise generated by turbulence from the grill cover to be dispersed in a direction that is different from the intended position of a listener.

Figure 8:
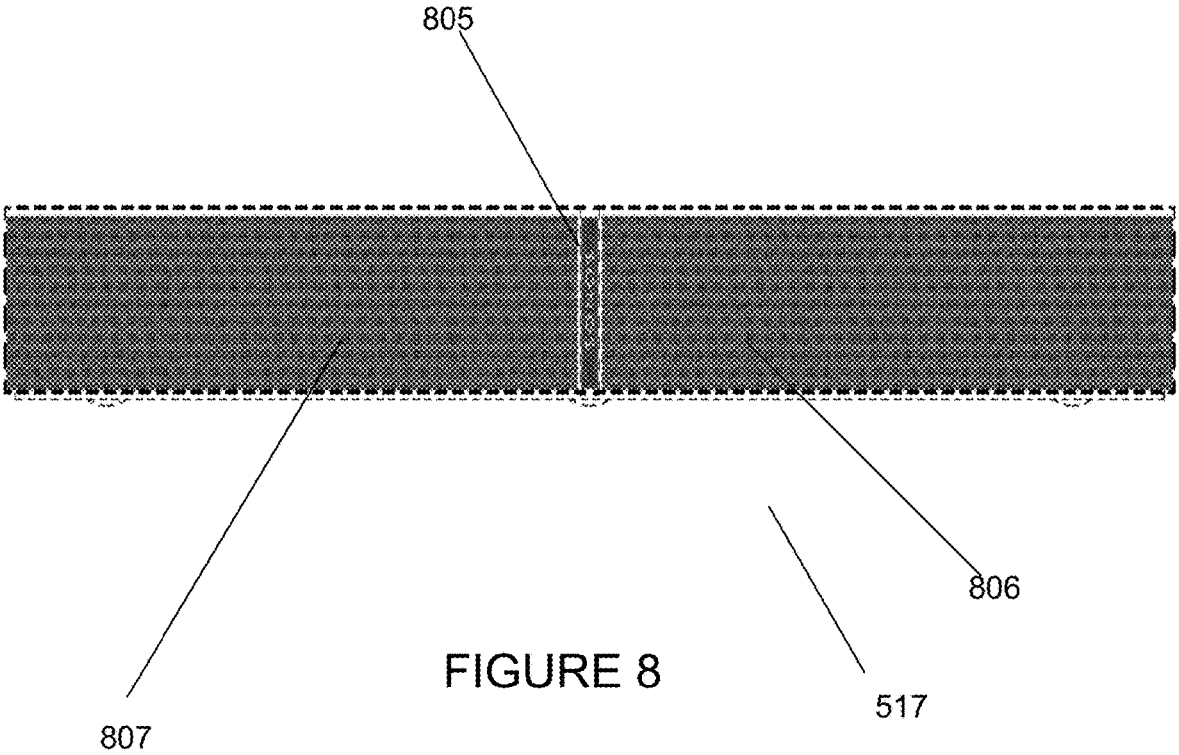
FIG. 8 shows a front view of an audio playback system in accordance with an embodiment of the invention.

A front side of playback device 500 with grill cover 517 in accordance with an embodiment of the invention is shown in FIG. 8. As seen, grill cover 517 includes two portions 806 and 807 that are over high frequency acoustical regions and transition portion 805 that is over an insignificant acoustical region. As such region 805 is solid in some embodiments. In accordance with some other embodiments region 805 includes an acoustically tuned brand tag as discussed in detail in U.S. patent application Ser. No. 14/831,903 previously incorporated by reference herein. In other embodiments, one or more output transducers may be placed in region 805 and the grill cover in the area includes openings appropriate to the transducer. In still other embodiments, a microphone or other input transducer is placed in region 805 and the grill cover in the area includes openings appropriate to the transducer.

Although an audio playback device with a grill cover having variably sized openings in accordance with an embodiment of this invention is discussed with reference to FIGS. 5-8, playback devices with different arrangements of components are envisioned in accordance with other embodiments of this invention.

A grill cover in accordance with some embodiments of this invention includes openings with a smaller areas in portions of the grill that cover high frequency acoustical regions and openings with larger areas in portions that cover low frequency acoustical regions. The portions over high frequency acoustical regions have smaller area openings because these regions have low airflow and thus require less area to dissipate the airflow. The portions of the grill cover over low frequency acoustical regions have openings with larger areas to dissipate the higher airflow generated in these regions. For example, in accordance with an embodiment, the openings over the high frequency regions are 0.7 mm in diameter and the openings over low frequency acoustical regions are 0.9 mm in diameter. In accordance with various other embodiments, the openings of high frequency acoustical regions have a diameter within a range of 0.6 mm-0.8 mm and the openings over the low frequency acoustical regions may have a diameter within a range of 0.8 mm and 1.0 mm. Although, the openings are expressed as circles, other shapes having similarly proportional areas may be used in accordance with some other embodiments of the invention.

In addition, the grill cover may have transition portions that are over acoustically insignificant regions of the housing. Some of these areas may also be in a visually less significant area (such as the areas under wrap-around portions 520 of grill cover 517 shown in FIG. 5). For purposes of this discussion, acoustically insignificant regions are regions where that have no acoustical importance or have openings for acoustical equipment for which the grill cover has less acoustical significance. For example, a corner may include no opening for acoustical equipment in some embodiments and has no acoustical importance in some embodiments. However, in some other embodiments, the corner area includes a side firing tweeter (high frequency speaker). In one example, the polarity of the side firing tweeter may be unaffected by the range of sufficiently sized openings in the transition portions. In other examples, an increased polar response due to less resistance in the substantially sideways direction and decreased polar response due to more resistance in the substantially forward direction of the wrap around section. In some cases, this behavior may be desirable and designed accordingly.

Portions of the grill cover over these areas may have opening of one or more intermediate sizes to mask the change of openings sizes in other portions of the grill cover. In addition, other disguises may be included in these regions including, but not limited to, changes in color and placing in areas of other visual distractions. Visual distractions can include, but are not limited to, logos, edges, curves, varied shadows, perspective shifts, and different viewing angles. The transition areas should not be over high frequency acoustical regions because the different opening size may cause a different polar response and should not be over low frequency acoustical regions because the smaller openings may add acoustical resistance and increase turbulence.

Furthermore, a sufficient amount of material should remain between openings to insure structural integrity of the grill cover. In accordance with some embodiments of the invention, at least 0.3 mm of material is required between adjacent openings. However, this amount will vary depending on one or more various factors including, but not limited to, the size of the opening, the type of material used for the grill, and the thickness of the grill.

Figure 9:
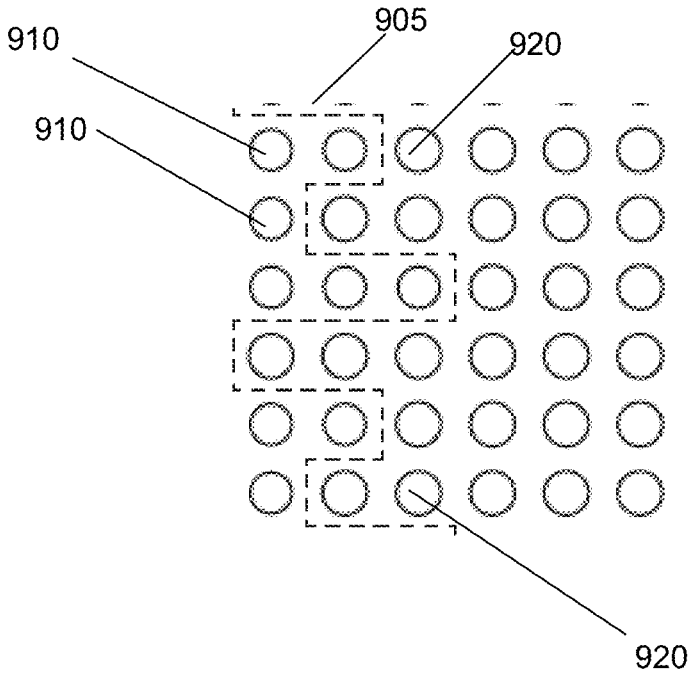
FIG. 9 shows an transition area in a speaker grill covering between openings over a high frequency driver and transitional openings in accordance with an embodiment of the invention.
Figure 10:
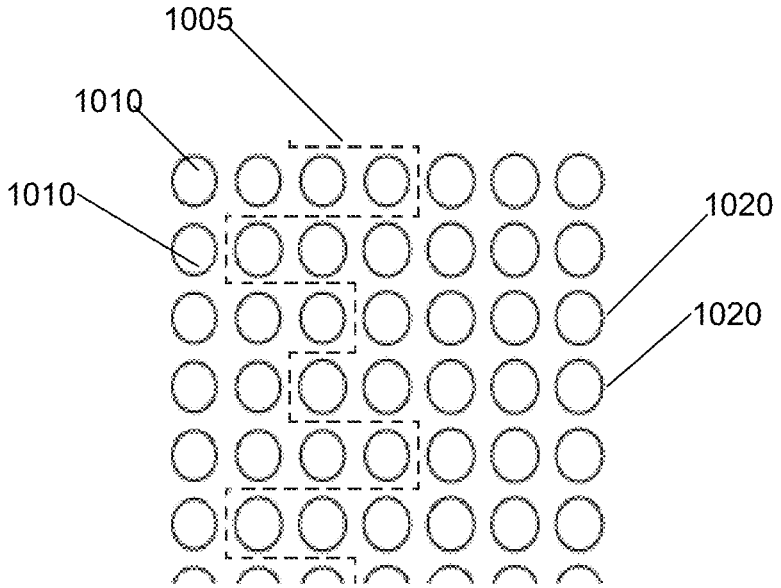
FIG. 10 shows an transition area in a speaker grill covering between openings over a low frequency driver and a transitional opening in accordance with an embodiment of the invention.

In addition, the interface between portions of the grill cover having different sized openings may use some form of interleaving between the two sizes to disguise the transition by breaking up the line of demarcation between portions. Two examples of interleaving opening at the interface of two portions of a grill cover having different sized openings in accordance with an embodiment of the invention is shown in FIGS. 9 and 10. In FIG. 9, openings 910 are smaller in a first portion of a grill cover than openings 920 in a second portion of the grill cover. Line 905 shows that in some rows openings 910 extend further into the rows of openings 920 forming a jagged or toothed arrangement of rows. In FIG. 9, every fifth row of openings 910 extend two openings into the rows of openings 920 followed by a row of openings 910 that extend one opening into the row of openings 920, followed by a row of openings 910 that extend 3 openings into the row of openings 920, and a row of openings 910 that do not extend into the openings of row 920. This pattern is repeated along the remainder of the interface area.

Similarly, openings 1010 are smaller in a first portion of a grill cover than openings 1020 in a second portion of the grill cover in FIG. 10. Line 1005 shows that in some rows openings 1010 extend further into the rows of openings 1020 forming a jagged or toothed arrangement of rows. In FIG. 10, every fifth row of openings 1010 extend four openings into the rows of openings 1020 followed by a row of openings 1010 that extends one opening into the row of openings 1020, followed by a row of openings 1010 that extend three openings into the row of openings 1020, and a row of openings 1010 that extends two openings into the openings of row 1020. This pattern is repeated along the remained of the interface area.

Referring back to FIG. 5, a grill cover 517 includes a portion 522 over a high frequency acoustical region on front side 510, a wrap-around portion 520 over an acoustically insignificant region, and a portion 525 of a low frequency acoustical region. The wrap-around portion 520 is a transitional portion that includes three different sizes of openings to make the transition from the smaller openings in portion 522 to the larger opening in portion 525 less perceptible. In accordance with this embodiment, the smaller openings in portion 522 are, for example, 0.7 mm in diameter; the three sizes of openings in wrap-around portion 520 are, for example, 0.75 mm, 0.8 mm, and 0.85 mm; and the openings in portion 525 are, for example, 0.9 mm. Various different patterns for disguising the transition between different sized openings in accordance with various embodiments of the invention are shown in FIGS. 11-17.

Figure 11:
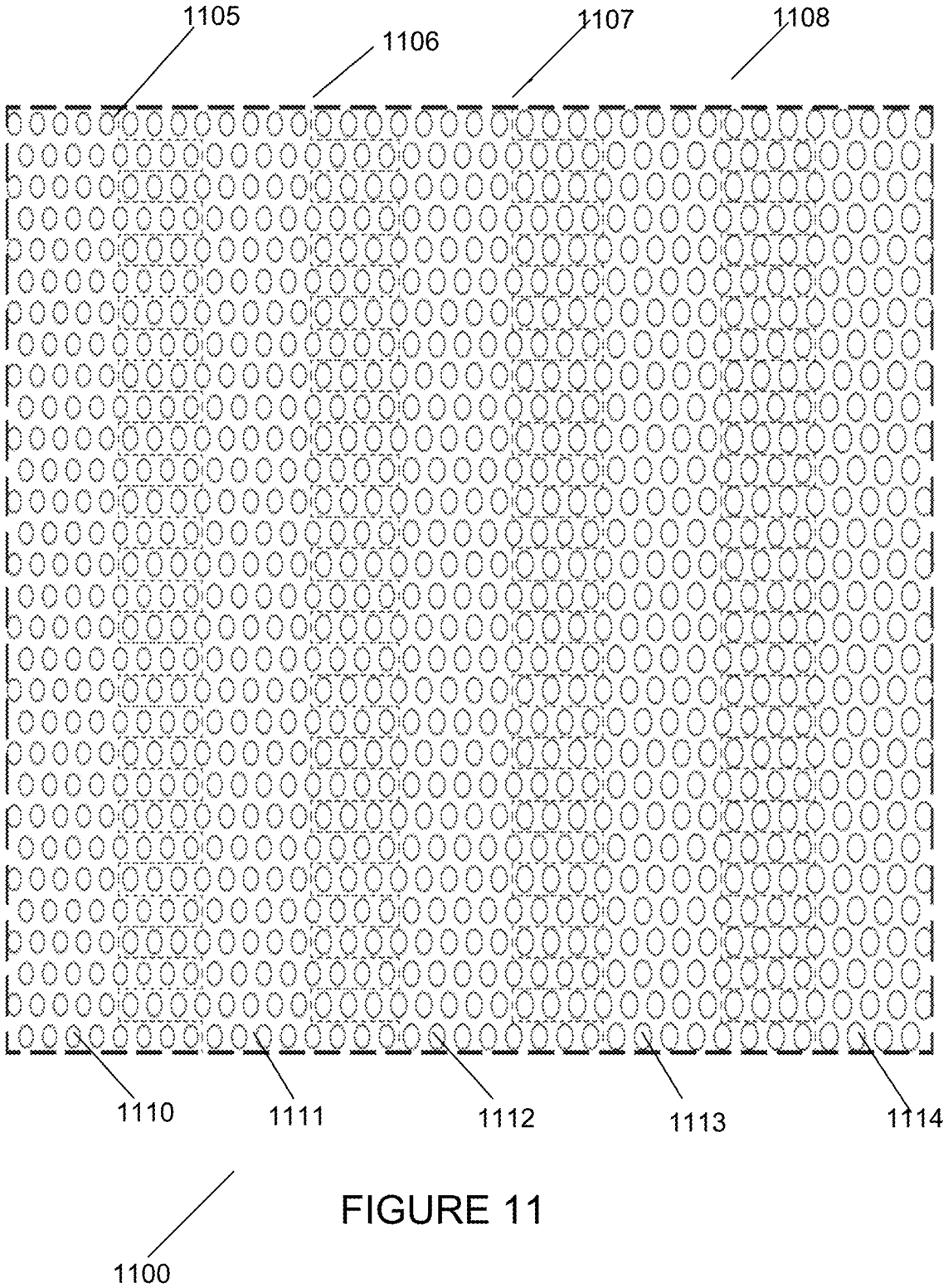
FIG. 11 shows a first opening pattern in a transitional area of a speaker grill covering in accordance with a first embodiment of the invention.

In pattern 1100, shown in FIG. 11, there are five different sized openings 1110-1114 and every row of openings is displaced one-half length of an opening from the openings in adjacent rows (i.e., the rows are offset one to another). Lines 1105-1108 indicate that at the interface between different sized openings every other row has the openings of different sizes extending four openings into region of different sized openings to create a pattern of uniformed sized teeth that interlock.

Figure 12:
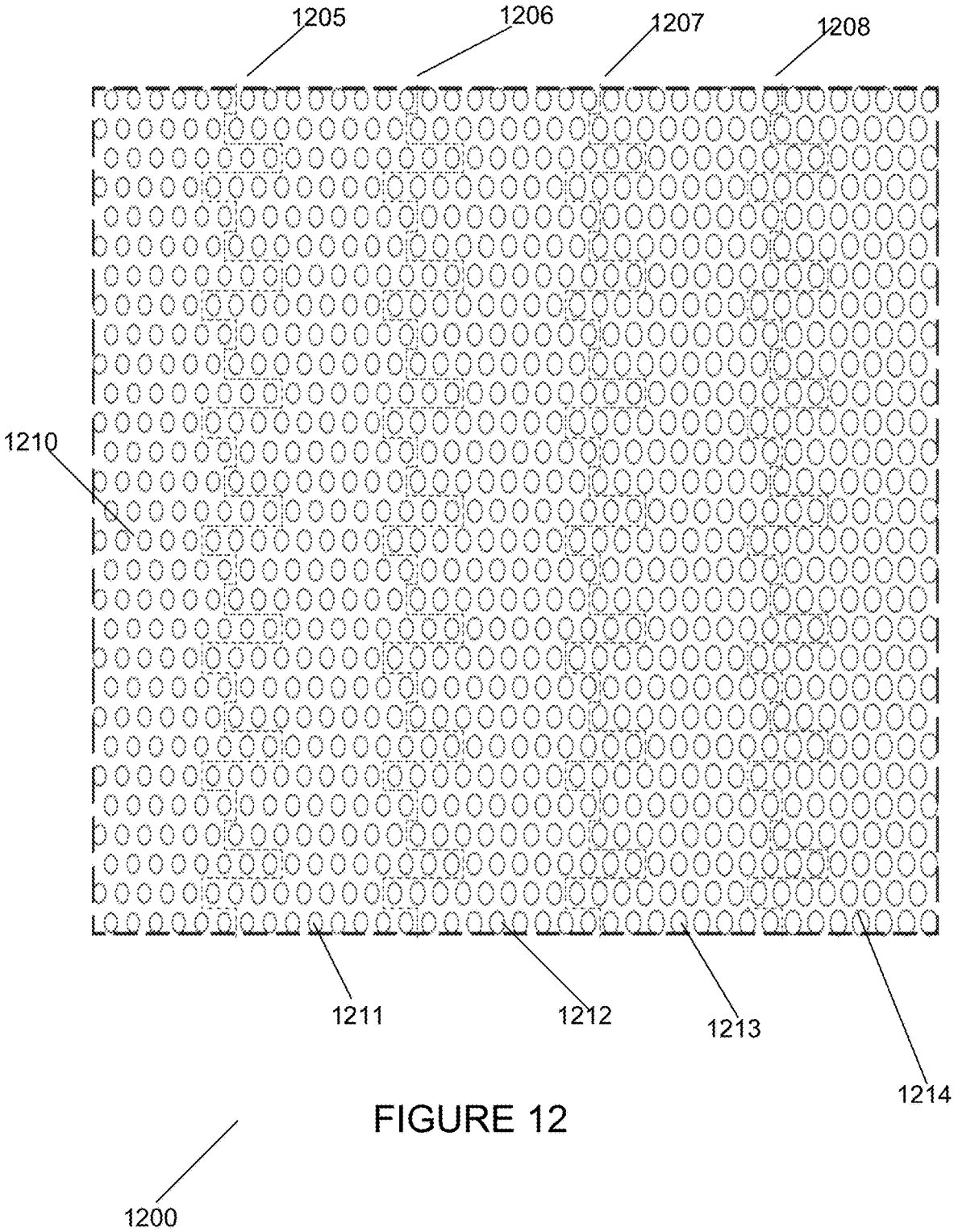
FIG. 12 shows a second opening pattern in a transitional area of a speaker grill covering in accordance with a second embodiment of the invention.

In pattern 1200, shown in FIG. 12, there are five different sized openings 1210-1214 and every row of openings is displaced one-half length of an opening from the openings in adjacent rows. Lines 1205-1208 indicate that at the interface between different sized openings the following pattern is followed. An upmost row of the smaller openings extend one opening in the row into the larger openings followed by a row in which the smaller openings do not extend into the row of larger openings, followed by a row that extends three openings into the row of larger openings, followed by row in which the larger openings extend one opening into the row of smaller openings. This pattern is then repeated through the remainder of the pattern forming a uniform jagged pattern of interlocking teeth between each of the regions.

Figure 13:
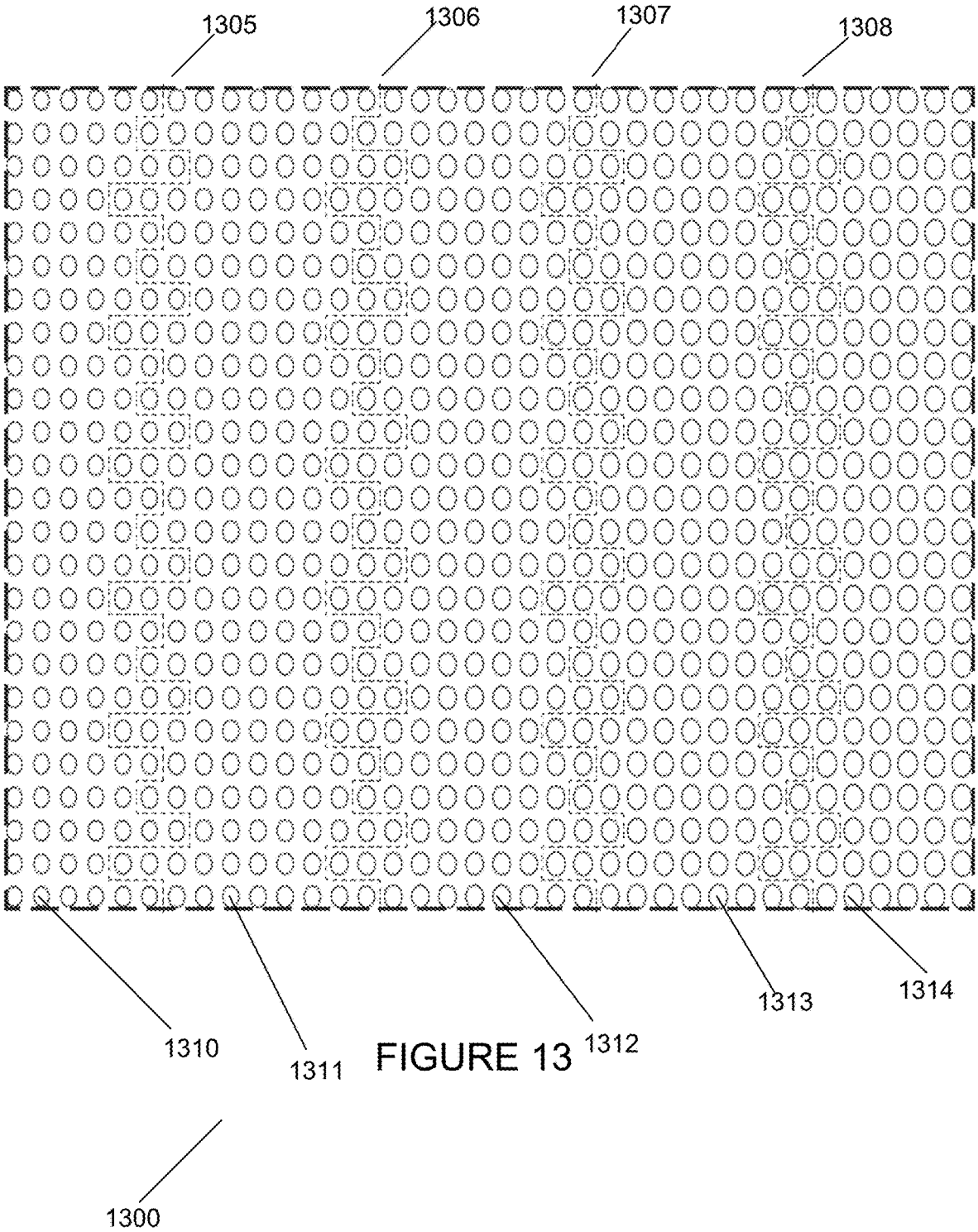
FIG. 13 shows a third opening pattern in a transitional area of a speaker grill covering in accordance with a first embodiment of the invention.

In pattern 1300, shown in FIG. 13, there are five different sized openings 1310-1314. Lines 1305-1308 indicate that at the interface between different sized openings the following pattern is followed. In a first row, the row of smaller openings extends one opening into the row of larger openings followed by a row with the row of larger openings extending one opening into the row of smaller openings followed by a row in which the row of smaller openings extend two openings into the row of larger openings followed by the row of larger openings extend two openings into the row of smaller openings. This pattern is then repeated for the remainder of the rows in the pattern forming a uniform jagged pattern of interlocking teeth between each of the regions.

Figure 14:
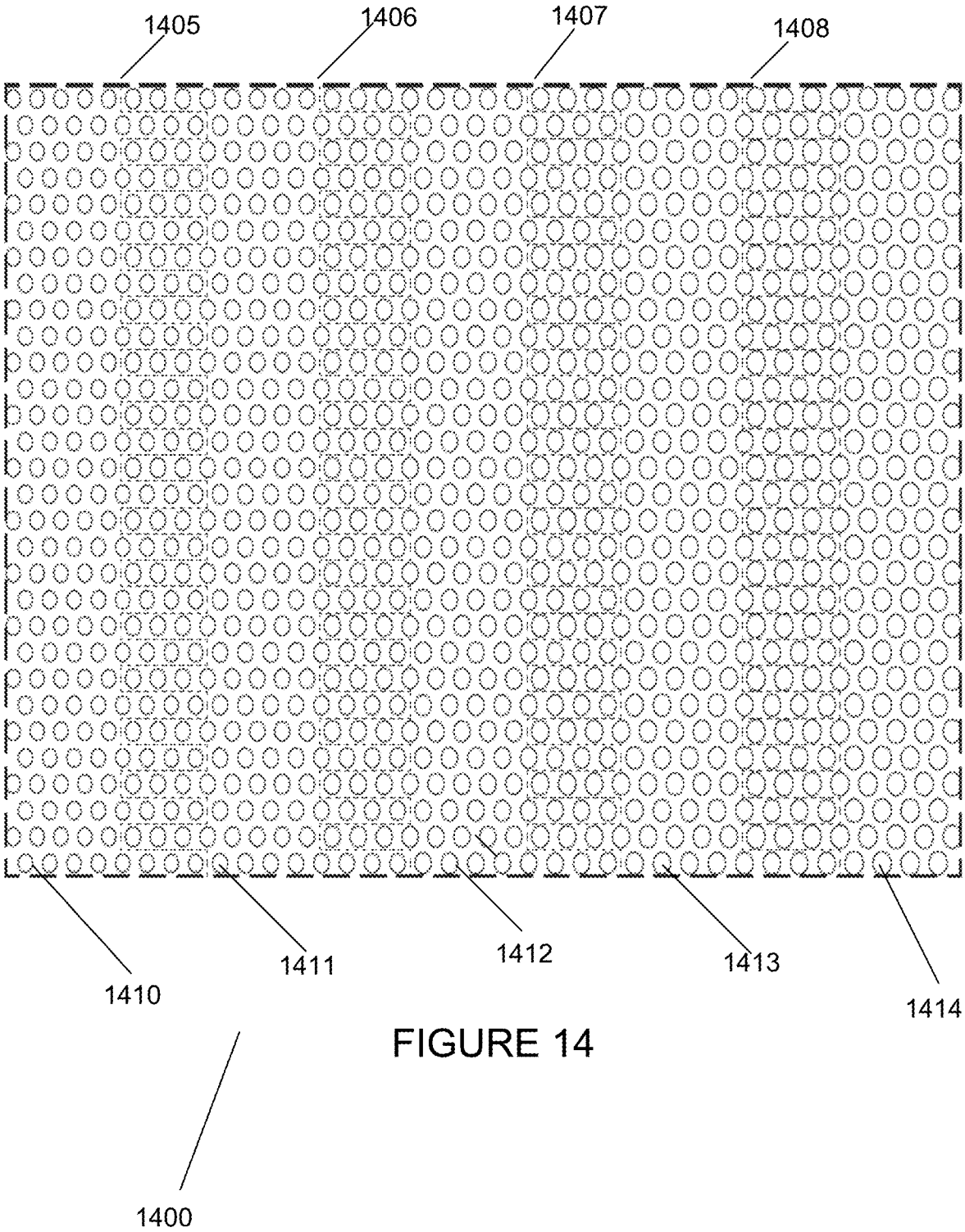
FIG. 14 shows a fourth opening pattern in a transitional area of a speaker grill covering in accordance with a first embodiment of the invention.

In pattern 1400, shown in FIG. 14, there are five different sized openings 1410-1414 and every row of openings is displaced one-half length of an opening from the openings in adjacent rows. Lines 1405-1408 indicate that at the interface between different sized openings the following pattern is followed. In a first row, the row of smaller openings extends four openings into the row of larger openings followed by a row with the row of larger openings extending four openings into the row of smaller openings. This pattern is then repeated for the remainder of the rows in the pattern forming a uniform jagged pattern of interlocking teeth between each of the regions.

Figure 15:
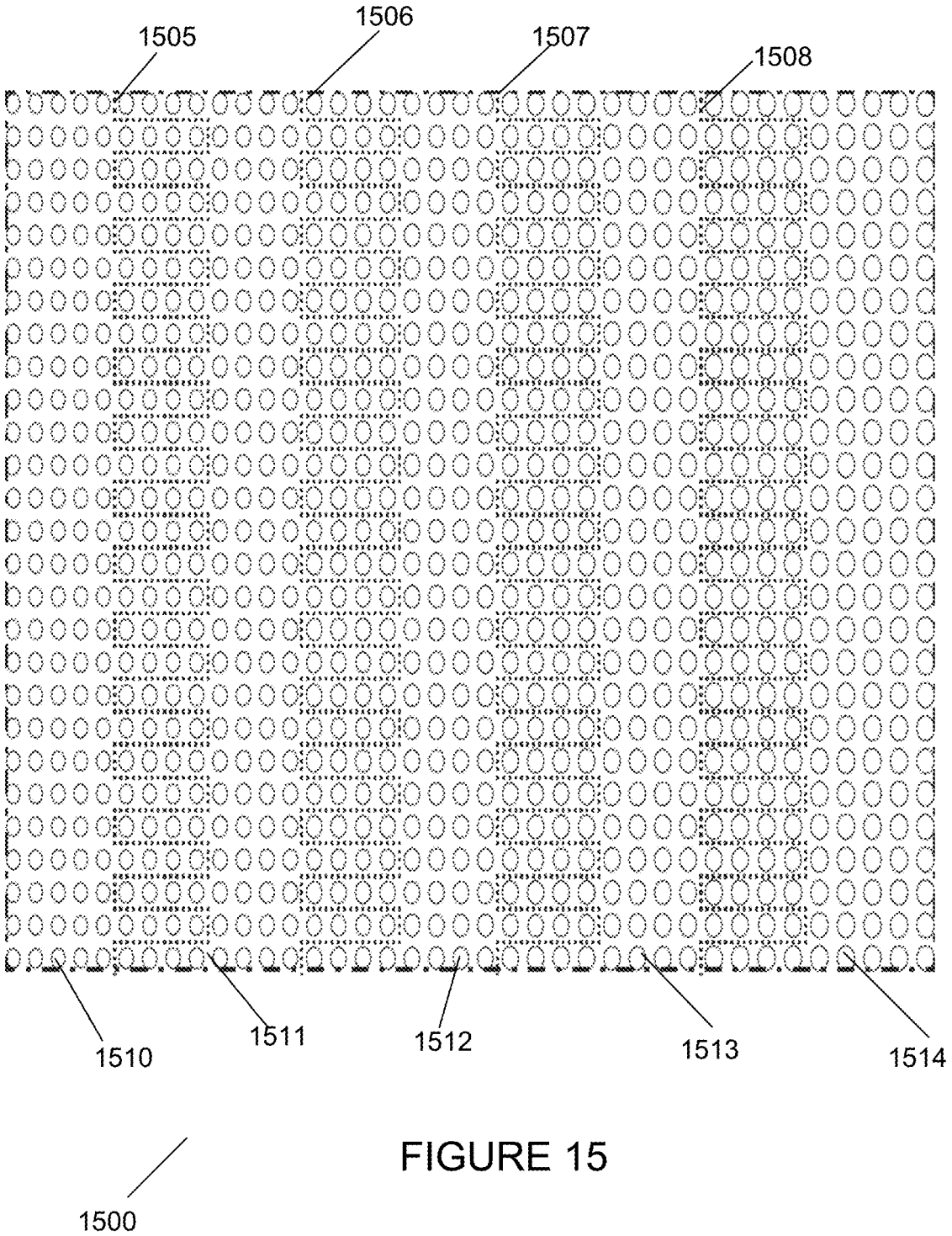
FIG. 15 shows a fifth opening pattern in a transitional area of a speaker grill covering in accordance with a fifth embodiment of the invention.

In pattern 1500, shown in FIG. 15, there are five different sized openings 1510-1514. Lines 1505-1508 indicate that at the interface between different sized openings the following pattern is followed. In a first row, the row of smaller openings extends four openings into the row of larger openings followed by a row with the row of larger openings extending four openings into the row of smaller openings. This pattern is then repeated for the remainder of the rows in the pattern forming a uniform jagged pattern of interlocking teeth between each of the regions.

Figure 16:
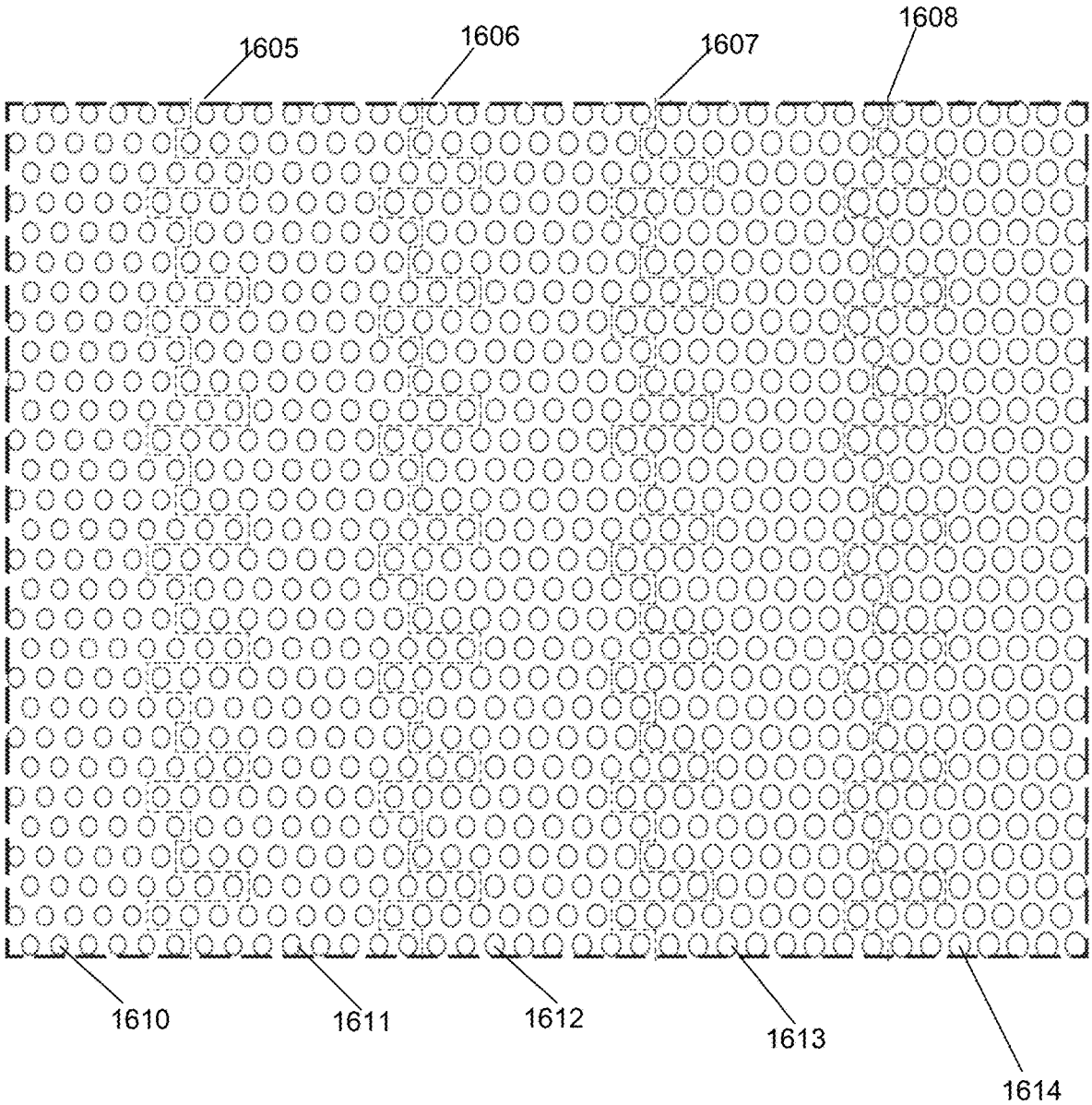
FIG. 16 shows a sixth opening pattern in a transitional area of a speaker grill covering in accordance with a sixth embodiment of the invention.

In pattern 1600, shown in FIG. 16, there are five different sized openings 1610-1614. Lines 1605-1608 indicate that at the interface between different sized openings the following pattern is followed. An upmost row of the smaller openings extend one opening in the row into the larger openings followed by a row in which the smaller openings do not extend into the row of larger openings, followed by a row that extends three openings into the row of larger openings, followed by a row in which the larger openings extend one opening into the row of smaller openings. This pattern is then repeated through the remainder of the pattern forming a uniform jagged pattern of interlocking teeth between each of the regions.

Figure 17:
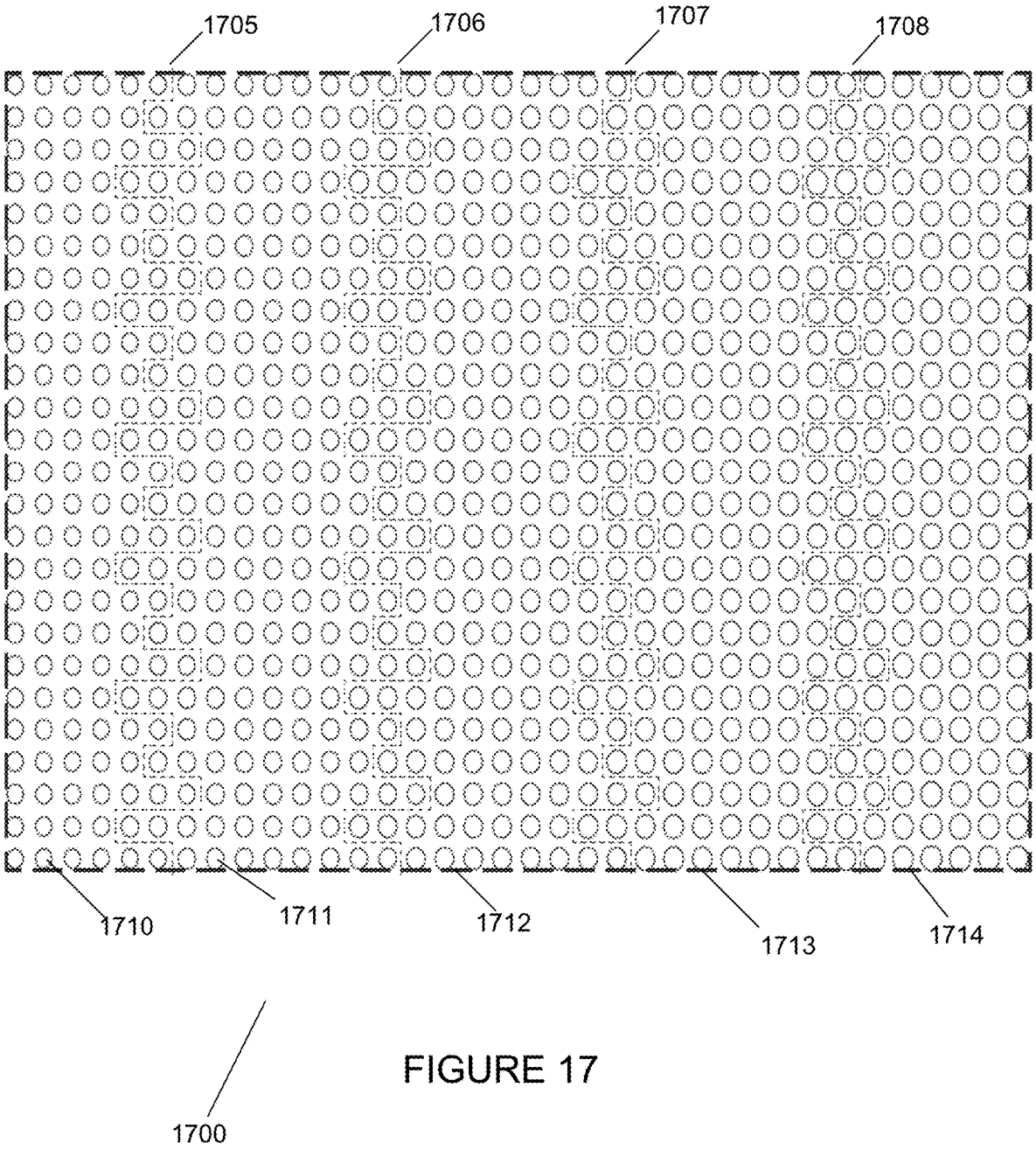
FIG. 17 shows a seventh opening pattern in a transitional area of a speaker grill covering in accordance with a seventh embodiment of the invention.

In pattern 1700, shown in FIG. 17, there are five different sized openings 1710-1714 and every row of openings is displaced one-half length of an opening from the openings in adjacent rows. Lines 1705-1708 indicate that at the interface between different sized openings the following pattern is followed. In a first row, the row of smaller openings extends one opening into the row of larger openings followed by a row with the row of larger openings extending one opening into the row of smaller openings followed by a row in which the row of smaller openings extend two openings into the row of larger openings followed by a row of larger openings extend two openings into the row of smaller openings. This pattern is then repeated for the remainder of the rows in the pattern forming a uniform jagged pattern of interlocking teeth between each of the regions.

Figure 18:
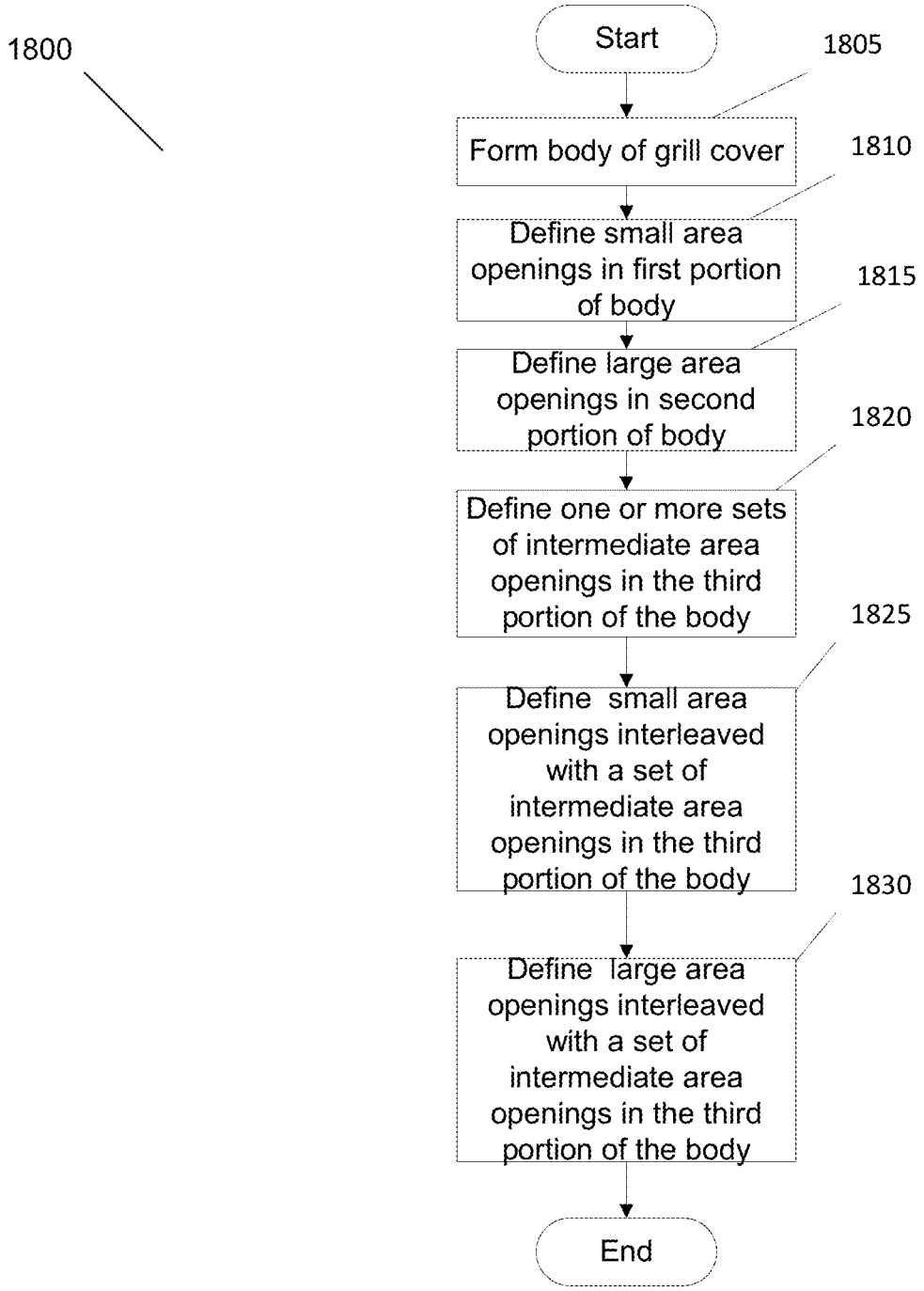
FIG. 18 shows a method for manufacturing a grill cover in accordance with embodiments of the invention.

A method for manufacturing a grill cover in accordance with several embodiments of the invention is shown in FIG. 18. Process 1800 includes forming a body of the grill cover (1805), defining small area openings in a first portion of the body that fits over a high frequency acoustical region of a playback device (1810), defining large area openings in a second portion of the body that fits over a low frequency acoustical region of a playback device (1815), defining one or more sets of intermediate area openings in a third portion of the body that fits over an acoustically insignificant region of a playback device (1820), defining small area openings interleaved with at least one set of the intermediate area openings in the third portion (1825), and defining large area openings interleaved with at least one set of the intermediate area openings in the third portion (1830). The defining of the small area, large area, and intermediate area openings (1810, 1815, 1820) may be accomplished in many different manners including, but not limited to, drilling, molding, milling, piercing, and stamping in various embodiments of the invention, the changing of the area of the opening size may be accomplished in different manners depending on the method used to form the openings including, but not limited to, changing tools (e.g. drill bits); changing CNC or another tool path (e.g. slot drill expanding perforation size via longer path); and varying the pattern in the mold used for molding the grill cover.

Although a process for manufacturing a grill cover in accordance with an embodiment of the invention is described above with reference to FIG. 18, one skilled in the art will recognize that other processes for manufacturing a grill cover that add, remove, combine, and/or reorder steps in the above described process are possible without departing from embodiments of this invention.

IV. Conclusion

The description above discloses, among other things, various example systems, methods, apparatus, and articles of manufacture including, among other components, firmware and/or software executed on hardware. It is understood that such examples are merely illustrative and should not be considered as limiting. For example, it is contemplated that any or all of the firmware, hardware, and/or software aspects or components can be embodied exclusively in hardware, exclusively in software, exclusively in firmware, or in any combination of hardware, software, and/or firmware. Accordingly, the examples provided are not the only way(s) to implement such systems, methods, apparatus, and/or articles of manufacture.

Additionally, references herein to "embodiment" means that a particular feature, structure, or characteristic described in connection with the embodiment can be included in at least one example embodiment of an invention. The appearances of this phrase in various places in the specification are not necessarily all referring to the same embodiment, nor are separate or alternative embodiments mutually exclusive of other embodiments. As such, the embodiments described herein, explicitly and implicitly understood by one skilled in the art, can be combined with other embodiments.

The specification is presented largely in terms of illustrative environments, systems, procedures, steps, logic blocks, processing, and other symbolic representations that directly or indirectly resemble the operations of data processing devices coupled to networks. These process descriptions and representations are typically used by those skilled in the art to most effectively convey the substance of their work to others skilled in the art. Numerous specific details are set forth to provide a thorough understanding of the present disclosure. However, it is understood to those skilled in the art that certain embodiments of the present disclosure can be practiced without certain, specific details. In other instances, well known methods, procedures, components, and circuitry have not been described in detail to avoid unnecessarily obscuring aspects of the embodiments. Accordingly, the scope of the present disclosure is defined by the appended claims rather than the forgoing description of embodiments.

When any of the appended claims are read to cover a purely software and/or firmware implementation, at least one of the elements in at least one example is hereby expressly defined to include a tangible, non-transitory medium such as a memory, DVD, CD, Blu-ray, and so on, storing the software and/or firmware.

We claim:

1. A grill cover that fits over at least a portion of a playback device comprising:

a body;

a first portion of the body that fits over a high frequency acoustical region of the playback device directed in a first direction, the first portion including a plurality of openings through the body wherein each of the plurality of openings has a small area configured to relieve a low airflow induced in the high frequency acoustical region; and a second portion of the body that fits over a low frequency acoustical region of the playback device directed in a second direction that is different from the first direction and having a second plurality of openings through the body wherein each of the second plurality of openings is sized to have a large area than is larger than the small area to relieve a high airflow induced by the low frequency acoustical region.

2. The grill cover of claim 1 further comprising:

a third portion of the body that is between the first portion and the second portion and fits over an acoustically insignificant region of the playback device that defines a third plurality of openings where each of the third plurality of openings are sized to have a first intermediate area that is greater than the small area and less than the large area.

3. The grill cover of claim 2 where the third portion defines a number of openings that are sized to have the small area that are interleaved with the third plurality of openings in the third portion.

4. The grill cover of claim 2 where the third portion defines a number of openings that are sized to have the large area that are interleaved with the third plurality of openings in the third portion.

5. The grill cover of claim 2 wherein the third portion of the body defines a fourth plurality of openings where each of the fourth plurality of openings are sized to a second intermediate area that is greater than the small area and less than the large area.

6. The grill cover of claim 5 wherein the third plurality of openings and the fourth plurality of openings are interleaved.

7. The grill cover of claim 2 wherein the third portion of the body is proximate a visual distraction associated with the playback device.

8. The grill cover of claim 2 wherein the third portion is a different color from at least one of the first and second portions of the body.

9. A method for manufacturing a grill cover for a playback device comprising:

forming a body of the grill cover;

defining a plurality of openings through a first portion of the body that fits over a high frequency acoustical region of the playback device directed in a first direction wherein each of the plurality of openings has a small area configured to relieve a low airflow induced in the high frequency acoustical region; and defining a second plurality of openings through a second portion of the body that fits over a low frequency acoustical region of the playback device directed in a second direction that is different from the first direction wherein each of the second plurality of openings is sized to have a large area than is larger than the small area to relieve a high airflow induced by the low frequency acoustical region.

10. The method of claim 9 further comprising:

defining a third plurality of openings through a third portion of the body that is between the first portion and the second portion and fits over an acoustically insignificant region of the playback device where each of the third plurality of openings are sized to have a first intermediate area that is greater than the small area and less than the large area.

11. The method of claim 10 further comprising defining a number of openings that are sized to have the small area in the third portion that are interleaved with the third plurality of openings in the third portion.

12. The method of claim 10 further comprising defining a number of openings in the third portion that are sized to have the large area that are interleaved with the third plurality of openings in the third portion.

13. The method of claim 10 further comprising defining a fourth plurality of openings in the third portion where each of the fourth plurality of openings are sized to a second intermediate area that is greater than the small area and less than the large area.

14. The method of claim 13 wherein the third plurality of openings and the fourth plurality of openings are interleaved.

15. The method of claim 11 wherein the third portion of the body is configured to be proximate a visual distraction associated with the playback device.

16. The method of claim 10 further comprising making the third portion a different color from at least one of the first and second portions of the body.

* * * * *